US006072966A

United States Patent [19]

Matsuo

[11] Patent Number: 6,072,966

[45] Date of Patent: Jun. 6, 2000

[54] CORONA CHARGING METHOD, CORONA CHARGER, AND IMAGE FORMATION APPARATUS EQUIPPED WITH CORONA CHARGER WHICH INTRODUCES A NON-OZONE-GENERATING GAS

[75] Inventor: Minoru Matsuo, Kanagawa, Japan

[73] Assignee: Ricoh Company, Ltd., Tokyo, Japan

[21] Appl. No.: 08/971,736

[22] Filed: Nov. 17, 1997

[30] Foreign Application Priority Data

| | | | |
|---|---|---|---|
| Nov. 15, 1996 | [JP] | Japan | 8-304477 |
| Feb. 7, 1997 | [JP] | Japan | 9-025347 |
| Feb. 24, 1997 | [JP] | Japan | 9-039103 |
| Feb. 27, 1997 | [JP] | Japan | 9-043158 |
| Feb. 27, 1997 | [JP] | Japan | 9-043159 |
| Nov. 6, 1997 | [JP] | Japan | 9-304552 |

[51] Int. Cl.[7] ..... G03G 15/02

[52] U.S. Cl. ..... 399/91; 250/324; 361/229; 361/230; 399/170; 430/902

[58] Field of Search ..... 399/170, 171, 399/172, 168, 385; 250/324, 325, 326; 361/213, 299, 230; 430/902; 426/11; 588/2

[56] References Cited

U.S. PATENT DOCUMENTS

| | | | |
|---|---|---|---|
| 5,045,241 | 9/1991 | Kuriyama et al. | 588/2 |
| 5,758,248 | 5/1998 | Yoshiuchi et al. | 399/385 |

FOREIGN PATENT DOCUMENTS

| | | |
|---|---|---|
| 59-204057 | 11/1984 | Japan . |
| 60-95459 | 5/1985 | Japan . |
| 61-211347 | 9/1986 | Japan . |

*Primary Examiner*—Susan S. Y. Lee
*Attorney, Agent, or Firm*—Oblon, Spivak, McClelland, Maier & Neustadt, P.C.

[57] ABSTRACT

A corona charging method of charging a chargeable material by corona charging in an ozone-generation hindering atmosphere including a non-ozone-generating gas, such as carbon dioxide. The corona charging method can be used, for example, in an image formation apparatus, in at least in one of a charging process, an image transfer process, or a charge quenching process for use therein.

29 Claims, 19 Drawing Sheets

CORONA CHARGING METHOD, CORONA CHARGER, AND IMAGE FORMATION APPARATUS EQUIPPED WITH CORONA CHARGER WHICH INTRODUCES A NON-OZONE-GENERATING GAS

BACKGROUND OF THE INVENTION

1. Field of the Invention

The present invention relates to a corona charging method and a corona charger for use in electrophotographic copying apparatus, facsimile apparatus and printers, and to an image formation apparatus equipped with a corona charger.

2. Discussion of Background

In image formation systems such as copying machines, printers, and facsimile apparatus, various methods such as electrophotographic image transfer method, thermal image transfer method, bubble jet method, and ink jet method are employed to develop latent invisible images to visible images.

Of these methods, the electrophotographic image transfer method is most widely used, in which electrically charged toner particles are transferred imagewise to an image transfer sheet. More specifically, in a representative electrophotographic image transfer method called "Carlson Process", a recording medium such as a photoconductor is electrically uniformly charged in the dark, and then exposed to a light image so as to form a latent electrostatic image on the recording medium. The above-mentioned charged toner is then deposited on the latent electrostatic image to form a visible toner image corresponding to the latent electrostatic image on the recording medium. The thus formed visible toner image is then transferred to an image transfer sheet such as a sheet of paper.

In such electrophotography, there is a charge transfer phenomenon in each of a charging process, development process, image transfer process, and charge quenching process. In order to have charges transferred subsequently in each of the above-mentioned processes, it is necessary to cause the generation of charges and the transfer of charges to a photoconductor, a charge bearing material, or an image transfer or receiving material. In other words, in order to perform the transfer of charges, an electric treatment called "charging" is carried out.

In order to perform such "charging", for instance, contact triboelectric charging, contact charge injection, and radiation ionization can be employed. Contact triboelectric charging and contact charge injection are carried out using a development roller and a charging roller.

However, when a charging member, such as a development roller or a charging roller, comes into contact with a chargeable member which is to be charged, low-molecular weight components from such a roller are deposited on the surface of the chargeable member, so that the chargeable member is contaminated with such low-molecular weight components, resulting in causing abnormality in image formation. Radiation ionization is not currently used in practice since exposure-proof is required although it depends upon the kind of radiation to be used.

A corona charging method, which is conventionally and currently most widely used, is carried out by applying a high voltage to an electrode made of a thin wire or a stylus, and performing corona charging between the electrode and a counter electrode to generate corona ions, thereby transferring the thus generated corona ions to a chargeable member or charging the chargeable member.

The principle of this corona charging method is simple and an apparatus for this method is also simple in mechanism. However, oxygen is contained in an amount of about 40% in volume in air, so that when corona charging is carried out in air, the oxygen in the air is ionized to generate ozone ($O_3$) Ozone is a poisonous substance, so that the generation thereof in offices is not preferable.

Furthermore, when corona charging is carried out in an atmosphere of nitrogen, corona ions change nitrogen into nitrogen oxides such as $NO_x$. When the thus formed $NO_x$ is deposited on the surface of a photoconductor, the hygroscopicity of the photoconductor is so increased that the charging performance of the photoconductor is caused to deteriorate significantly. Under such circumstances, some other improved method is desired.

One method is proposed to reduce the generation of ozone, in which charge injection is carried out, with a charging member being disposed in contact with a chargeable member, or corona charging is carried out between the charging member and the chargeable member which are closely disposed, utilizing Paschen's law, and begins to be used.

However, the above-mentioned contact charging method basically uses corona charging, so that as long as charging is conducted in an air-containing atmosphere, the generation of ozone is inevitable. Under such circumstances, a method of injecting an inert gas such as argon in the contact charging method has been proposed as disclosed in Japanese Laid-Open Patent Application 59-204057, and also a method of using a gas with an oxygen content thereof being less than that of air has been proposed to minimize the generation of ozone as disclosed in Japanese Laid-Open Patent Application 60-95459.

As a matter of fact, the generation of ozone can be reduced as the content of oxygen in the gas is reduced. However, the generation of ozone cannot completely be prevented. Therefore some complicated mechanism, such as a mechanism in which a gas separation filter is used, is inevitably required.

Furthermore, as long as the corona charging phenomenon is used, a luminescence phenomenon inevitably takes place simultaneously with the corona charging. This luminescence phenomenon can be easily observed in a dark room.

A latent electrostatic image is formed on a photoconductor with such a mechanism that the photoconductor, which is a dielectric material, is uniformly charged in the dark, and the uniformly charged photoconductor is then exposed to the light of a light image, so that the portions exposed to the light image of the photoconductor become electroconductive and accordingly the charges in the portions exposed to light dissipate away through a ground, or the charges in the portion exposed to light are neutralized by the electric charges with a polarity opposite to the polarity of the charges therein, injected thereto from the side of the ground, whereby a latent electrostatic image corresponding to the light image is formed on the surface of the photoconductor. In the course of the charging process with the above-mentioned mechanism, the occurrence of the luminescence phenomenon adversely reduces the charging effect. In conventional image formation apparatus such as copying machines, the occurrence of the luminescence phenomenon is not a problem because the luminescence is extremely slight in view of the quality of images to be produced. However, recently the formation of extremely high quality images with high speed is desired and accordingly highly photosensitive photoconductors are being used. Under such circumstances, the adverse effects of the above-mentioned luminescence phenomenon cannot be ignored.

SUMMARY OF THE INVENTION

It is therefore a first object of the present invention to provide a non-contact type corona charging method which is substantially free of the generation of ozone and NOx gases in contrast to a conventional corona charging method, without requiring any complicated mechanism.

A second object of the present invention is to provide a corona charging method of the above-mentioned non-contact type, which is capable of performing stable corona charging in an ozone-generation hindering atmosphere in which no ozone and NOx gases are substantially generated.

A third object of the present invention is to provide a corona charger for conducting the above-mentioned corona charging method, particular, which is conducted in the ozone-generation hindering atmosphere.

A fourth object of the present invention is to provide an image formation apparatus using the above-mentioned corona charger.

A fifth object of the present invention is to provide an image formation apparatus capable of forming images with excellent contrast without increasing application voltage.

A sixth object of the present invention is to provide an image formation apparatus, which uses a corona charging method free of the generation of ozone and NOx gases and is capable of forming images with high quality, utilizing the luminescence generated during the corona charging.

The first and second objects of the present invention can be achieved by a non-contact type corona charging method of electrically charging a chargeable material in an ozone-generation hindering atmosphere consisting essentially of a non-ozone-generating gas, for instance, in an image formation apparatus, such as copying apparatus, facsimile apparatus and printers, at least in one of a charging process, an image transfer process, or a charge quenching process thereof.

In the present specification, the term "non-ozone-generating gas" is defined as a gas except inert gas such as helium and argon, and nitrogen gas, which does not generate ozone by corona charging in the presence of oxygen or air. The "non-ozone-generating gas" may also be referred to as the "charging atmosphere gas" in the present specification.

In the corona charging method of the present invention, it is preferable that the non-ozone-generating gas, that is, the "charging atmosphere gas" be a gas which has a specific gravity larger than the specific gravity of air. A preferable example of the charging atmosphere gas is carbon dioxide.

Particularly, in order to obtain a stable corona charging current and to reduce the generation of ozone and NOx gases significantly, the above-mentioned first and second objects of the present invention can also be achieved by a corona charging method of charging a chargeable material by corona charging in an ozone-generation hindering atmosphere consisting essentially of a non-ozone-generating gas, comprising the steps of:

detecting whether or not the concentration of the non-ozone-generating gas in the ozone-generation hindering atmosphere is in a predetermined range in which the generation of ozone can be hindered, and when the concentration of the non-ozone-generating gas is not in the predetermined range, supplying the non-ozone-generating gas to the ozone-generation hindering atmosphere until the concentration of the non-ozone-generating gas reaches the predetermined range.

Furthermore, in order to obtain a stable corona charging current with a constant generation of corona ions and to reduce the generation of ozone and NOx gases significantly in the course of corona charging over an extended period of time, the first and second objects of the present invention can be achieved by a corona charging method of charging a chargeable material by corona charging at a predetermined corona charging current in an ozone-generation hindering atmosphere consisting essentially of a non-ozone-generating gas, comprising the steps of:

detecting the deviation of the corona charging current from the predetermined corona charging current, and when the corona charging current is detected to be deviating from the predetermined corona charging current, supplying the non-ozone-generating gas to the atmosphere until the corona charging current reaches the predetermined corona charging current.

The third object of the present invention can be achieved by a corona charger in which corona charging is carried out in an ozone-generation hindering atmosphere comprising a non-ozone-generating gas.

Such a corona charger can be used at least in one of a charging unit, an image transfer unit or a charge quenching unit for an image formation apparatus such as copying machines, facsimile apparatus and printers.

In the corona charger, it is preferable that the non-ozone-generating gas be a gas which has a specific gravity larger than the specific gravity of air. A preferable example of the non-ozone-generating gas is carbon dioxide as mentioned above.

In the corona charger of the present invention, since the corona charging is conducted in the above-mentioned "charging atmosphere gas", the generation of ozone is not only hindered, but the corona charging efficiency is significantly high. Furthermore, when the corona charging of the present invention is used, for instance, in an image formation apparatus comprising a photoconductor which is a chargeable member, non-contact charging is conducted, with a charging member being kept out of contact with the photoconductor, so that there is no risk that the photoconductor is contaminated by adverse materials which may be produced during charging and accordingly high quality images can be continuously produced.

An organic photoconductor is vulnerable to ozone. However, in the present invention, since the generation of ozone is hindered or minimized, the life of the organic photonductor can be significantly extended.

The ionization efficiency of a corona charging system is higher than that of a contact charging system, and the corona charger using a wire electrode is simpler in structure and less expensive than a contact charging member employed in the contact charging system.

Furthermore, when as the "charging atmosphere gas" a gas which has a larger specific gravity than that of air is used, the gas tends to stay at a lower portion in a stable manner for a long time, with air being replaced by the gas, so that the composition of the gas does not change very much. Therefore, stable charging conditions can be attained without the necessity for supplying the gas frequently.

Carbon dioxide used as the "charging atmosphere gas" is an easily available, inexpensive gas.

Furthermore, in order to obtain a stable corona charging current with a constant generation of corona ions and to reduce the generation of ozone and NOx gases significantly in the course of corona charging over an extended period of time, the third object of the present invention can also be achieved by a corona charger for corona charging a chargeable member in an ozone-generation hindering atmosphere comprising a non-ozone-generating gas, comprising:

a container having an opening, for holding and maintaining the ozone-generation hindering atmosphere, a pair of electrodes disposed in the container, a high voltage power source for applying a corona charging voltage across the pair of electrodes, thereby generating corona ions in the container in order to perform corona charging the chargeable member, non-ozone-generating gas supply means for supplying the non-ozone-generating gas to the ozone-generation hindering atmosphere in the container so as to maintain the ozone-generation hindering atmosphere, non-ozone-generating gas supply adjusting means for adjusting the supply of the non-ozone-generating gas to the ozone-generation hindering atmosphere in the container so as to maintain the ozone-generation hindering atmosphere, gas detection means for detecting the non-ozone- generating gas, evaluating the concentration thereof, and outputting a signal indicating the evaluated concentration of the non-ozone-generating gas, and control means for controlling the non-ozone-generating gas supply adjusting means in response to the signal output from the gas detection means.

In the above corona charger, it is preferable that the non-ozone-generating gas have a specific gravity larger than the specific gravity of air, and the opening of the container be opened upward, opposite to the direction of gravity.

As mentioned above, as the non-ozone-generating gas, carbon dioxide is preferable for use in the above charger.

Further, in the above-mentioned corona charger, the gas detection means may be a gas concentration detector which watches and checks whether or not the non-ozone-generating gas supplied by the non-ozone-generating gas supply means to the ozone-generation hindering atmosphere in the container is in an appropriate range so as to maintain the ozone-generation hindering atmosphere.

Further, in the above corona charger, the gas detection means may be a generation gas concentration detector which detects a gas which is generated in the presence of air during the corona charging in the ozone-generation hindering atmosphere, and evaluates the concentration thereof.

In the above corona charger, the gas which is generated in the presence of air during the corona charging in the ozone-generation hindering atmosphere may be either ozone or a NOx gas.

Further, in the above corona charger, the gas detection means may be a gas concentration detector which watches and checks whether or not air enters the ozone-generation hindering atmosphere in the container and evaluates the concentration of air in the ozone-generation hindering atmosphere.

The third object of the present invention can also be achieved by a corona charger for corona charging a chargeable member at a predetermined corona charging current in an ozone-generation hindering atmosphere comprising a non-ozone-generating gas, comprising:

a container having an opening, for holding and maintaining the ozone-generation hindering atmosphere, a pair of electrodes disposed in the container, a high voltage power source for applying a corona charging voltage across the pair of electrodes, thereby generating corona ions in the container in order to perform corona charging the chargeable member, non-ozone-generating gas supply means for supplying the non-ozone-generating gas to the ozone-generation hindering atmosphere in the container so as to maintain the ozone-generation hindering atmosphere, non-ozone-generating gas supply adjusting means for adjusting the supply of the non-ozone-generating gas to the ozone-generation hindering atmosphere in the container so as to maintain the ozone-generation hindering atmosphere, a corona charging current detection means for detecting the deviation of the corona charging current from the predetermined corona charging current, evaluating the deviation thereof, and outputting a signal indicating the evaluated deviation of the corona charging current, and control means for controlling the non-ozone-generating gas supply adjusting means in response to the signal output from the corona charging current detection means.

The above-mentioned charger is capable of providing a stable corona charging current with a constant generation of corona ions and also capable of reducing the generation of ozone and NOx gases significantly in the course of corona charging over an extended period of time, without needing a particular space for achieving the effects since only the deviation of the corona charging current is monitored for the control of the provision of the stable corona charging current with a constant generation of corona ions and the significant reduction of the generation of ozone and NOx gases.

In the above corona charger, it is preferable that the non-ozone-generating gas have a specific gravity larger than the specific gravity of air, and that the opening of the container be opened upward, opposite to the direction of gravity, since it is easy to replace the air in the container with the non-ozone-generating gas when supplying the non-ozone-generating gas, and the non-ozone-generating gas does not easily diffuse into the air, since the specific gravity of the non-ozone-generating gas is greater than the specific gravity of air, therefore, the non-ozone-generating gas can stay long and it is unnecessary to supply the non-ozone-generating gas continuously or frequently.

Further, it is preferable that in the above corona charger that carbon dioxide be employed as the non-ozone-generating gas, since when air enters the ozone-generation hindering atmosphere and is mixed with the carbon dioxide in the ozone-generation hindering atmosphere, the corona charging current sensitively increases, so that the contamination of carbon dioxide with air can be easily detected, and carbon dioxide is easily available and inexpensive.

The third object of the present invention can also be achieved by a corona charger for corona charging a chargeable member in an ozone-generation hindering atmosphere comprising a non-ozone-generating gas having a specific gravity larger than the specific gravity of air, comprising a container having an upper opening, which holds the ozone-generation hindering atmosphere, which is disposed below the chargeable member, with the upper opening thereof being directed toward the chargeable member.

By use of the above corona charger, the corona charging can be conducted in a stable manner for an extended period of time, since the ozone-generation hindering atmosphere can be maintained in a stable manner.

For the same reasons as mentioned above, it is preferable that carbon dioxide be employed as the non-ozone-generating gas in this charger as well.

Further, the corona charger may further comprise non-ozone-generating gas supply means for supplying the non-ozone-generating gas to the ozone-generation hindering atmosphere, which is connected to the container.

In the above corona charger, the non-ozone-generating gas supply means may be connected to the container at a bottom portion thereof.

The non-ozone-generating gas supply means for use in the above corona charger may be a gas cylinder filled with the non-ozone-generating gas with high pressure.

The fourth and fifth objects of the present invention can be achieved by an image formation apparatus which comprises a charging unit, an image transfer unit and a charge quenching unit and is capable of charging a chargeable material, wherein in at least one of the charging unit, the image transfer unit and the charge quenching unit, corona charging is carried in an ozone-generation hindering atmosphere comprising a non-ozone-generating gas having a specific gravity larger than the specific gravity of air.

In the above image formation apparatus, as the chargeable material, a photoconductor comprising as the main component an amorphous silicon, which may be referred to as an amorphous silicon photoconductor, can be employed. The anmorphous silicone photoconductor has advantages over other photoconductors such as Se photoconductor that excellent image contrast can be obtained with a relatively low potential development, which contributes to the saving of energy, and the extension of the life of the photoconductor and other charging units.

Further in the above image formation apparatus, when the surface potential of the photoconductor, prior to exposure to light, is set at 400 V, images with excellent image gradation can be obtained.

The sixth object of the present invention can be achieved by the above image formation apparatus in which, as the "charging atmosphere gas" or the non-ozone-generating gas, a gas having a larger specific gravity larger than that of air can be employed, preferably carbon dioxide is used. When carbon dioxide is used, the generation of ozone and the formation of blurred images can be prevented. Furthermore, when corona charging is carried out in the presence of carbon dioxide, the intensity of luminescence generated is much smaller than the intensity of luminescence generated in the presence of air or argon, so that the reduction of charges on the photoconductor by such luminescence in the presence of carbon dioxide is much smaller than that in the presence of air or argon, and accordingly the blurring of produced images is less.

The fourth, fifth and sixth objects of the present invention can be achieved by an image formation apparatus comprising a charger for corona charging a latent electrostatic image bearing member in an ozone-generation hindering atmosphere comprising a non-ozone-generating gas which has a specific gravity larger than the specific gravity of air and, preferably in an ozone-generation hindering atmosphere consisting essentially of carbon dioxide, with the latent electrostatic image bearing member bearing a latent electrostatic image formed by being exposed to a white light emitted from an exposure light source.

In the above image formation apparatus, as the exposure light source, latent electrostatic images are formed on the photoconductor by an analog system using a white-color light source, and the charging atmosphere gas is substantially carbon dioxide, so that even if the luminescence is generated during corona charging, the color of the luminescence is white. The result is that the reduction of the charges on the photoconductor by the luminescence takes place panchromatically and accordingly the color reproduction is maintained good.

In the above-mentioned image formation apparatus, it is preferable that the photoconductor used as the latent electrostatic image bearing member have a photosensitivity of 0.1 $m^2/mJ$ or more, in terms of the photosensitivity level applied to the photosensitivity of SeAs alloy photoconductor and amorphous Si photoconductor, in order to attain high speed copying.

The fourth, fifth and sixth objects of the present invention can also be achieved by an image formation apparatus comprising a charger for corona charging a latent electrostatic image bearing member in an ozone-generation hindering atmosphere comprising a non-ozone-generating gas which has a specific gravity larger than the specific gravity of air, preferably in an ozone-generation hindering atmosphere consisting essentially of carbon dioxide, with the latent electrostatic image bearing member bearing a latent electrostatic image formed by being exposed to a green to blue light emitted from a single color exposure light source.

In the above-mentioned image formation apparatus, latent electrostatic images are formed on the photoconductor by a digital system using the single color exposure source which emits a green to blue light, and the charging atmosphere gas is substantially carbon dioxide, so that even if the luminescence is generated during corona charging, the color of the luminescence is nearly white when the single color exposure source which emits a green to blue light is used. The result is that the reduction of the charges on the photoconductor by the luminescence takes place far less than in the presence of air or argon as the charging atmosphere gas.

Furthermore, the fourth, fifth and sixth objects of the present invention can also be achieved by an image formation apparatus which comprises:

a charging unit, an image transfer unit, a charge quenching unit, wherein at least one of the charging unit, the image transfer unit or the charge quenching unit comprises a corona charger and is capable of corona charging a chargeable material, in which corona charging is carried in an ozone-generation hindering atmosphere comprising a non-ozone-generating gas having a specific gravity larger than the specific gravity of air, the corona charger comprising a container having an upper opening, which holds the ozone-generation hindering atmosphere, which is disposed below the chargeable member, with the upper opening thereof being directed toward the chargeable member, and non-ozone-generating gas supply means for supplying the non-ozone-generating gas to the ozone-generation hindering atmosphere in the container so as to maintain the ozone-generation hindering atmosphere, gas detection means for detecting the non-ozone-generating gas, measuring and evaluating the residual amount of the non-ozone-generating gas in the non-ozone-generating gas supply means, and outputting a signal indicating the evaluated residual amount of the non-ozone-generating gas, and warning display means for providing a warning display signal when the residual amount of the non-ozone-generating gas in the non-ozone-generating gas supply means decreased below a predetermined amount in response to the signal indicating the evaluated residual amount of the non-ozone-generating gas.

In the above-mentioned image formation apparatus, the gas detection means may be a pressure meter for evaluating the pressure of the non-ozone-generating gas supplied from the non-ozone-generating gas supply means.

Further, in the above-mentioned image formation apparatus, the gas detection means may be a flow rate meter for evaluating the flow rate of the non-ozone-generating gas supplied from the non-ozone-generating gas supply means.

Further, the above-mentioned non-ozone-generating gas supply means may comprise a gas cylinder for holding the non-ozone-generating gas therein.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

With reference to the accompanying drawings, the present invention will now be explained in detail.

Figure 1:
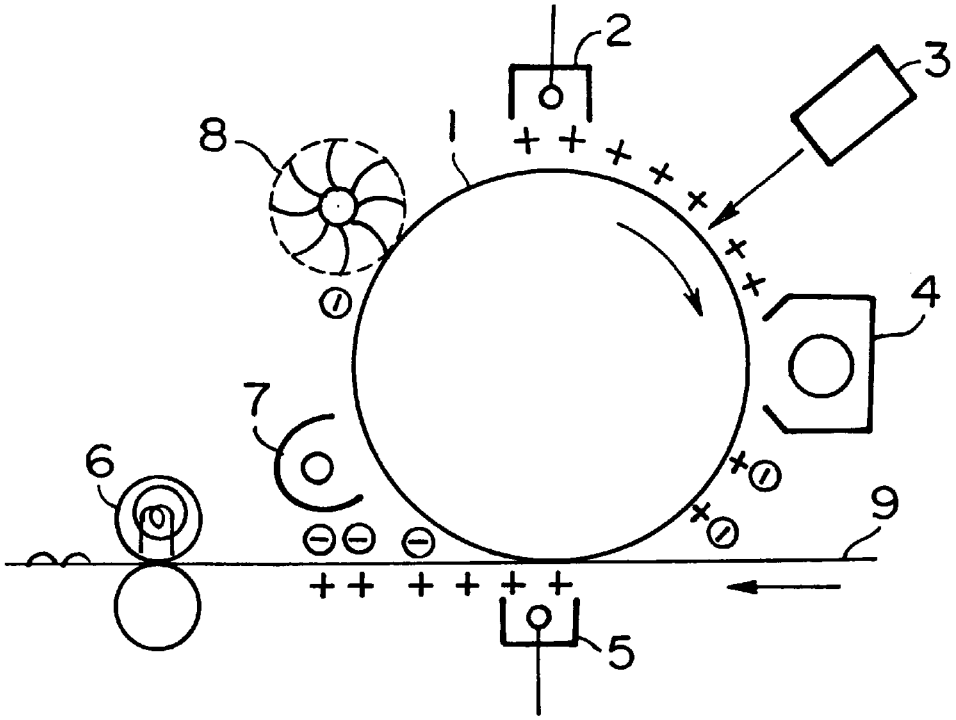
FIG. 1 is a schematic cross-sectional view of an image formation apparatus utilizing a Carlson process, provided with a charging apparatus of the present invention.

FIG. 1 is a schematic cross-sectional view of an image formation apparatus utilizing a Carlson process, provided with a charging apparatus of the present invention.

This image formation apparatus comprises a photoconductor drum 1 which is a drum-shaped photoconductor made of Se and Se alloy, zinc oxide, cadmium sulfide, or an organic photoconductor (OPC), a charger 2 for uniformly charging the surface of the photoconductor drum 1, an exposure unit 3 for forming a latent electrostatic image on the surface of the photoconductor drum 1, a development unit 4 for developing the latent electrostatic image to a visible toner image, an image transfer unit 5 for transferring the toner image to a recording paper 9, an image fixing unit 6 for fixing the transferred toner image to the recording paper 9 permanently, a charge quenching unit 7 for quenching the charges of the electrostatic image remaining on the surface of the photoconductor drum 1, and a cleaning unit 8 for cleaning the surface of the photoconductor drum 1 by removing the residual toner therefrom.

The recording process for this image formation apparatus comprises a charging process, an exposure process, a development process, an image transfer process, an image fixing process, a charge quenching process, and a cleaning process, which are successively and repeatedly carried out, whereby printing is carried out repeatedly.

In the charging process, the surface of the photoconductor drum 1 is uniformly charged in the dark by the charger 2.

In the exposure process, the uniformly charged surface of the photoconductor drum 1 is exposed to a light image by the exposure unit 3, so that the charges in the portions exposed to the light of the light image on the surface of the photoconductor drum 1 are caused to dissipate away, while the charges in the portions which are not exposed to the light of the light image, corresponding to the image area of the light image, on the surface of the photoconductor drum 1 remain, whereby a latent electrostatic image corresponding to the light image is formed on the surface of the photoconductor drum 1.

In the development process, colored fine particles which are charged to a polarity opposite to the polarity of the latent electrostatic image (that is, a so-called toner) are deposited on the latent electrostatic image by the development unit 4, whereby the latent electrostatic image is developed into a visible toner image.

In the image transfer process, the recording paper 9 is superimposed on the visible toner image, and charges with a polarity opposite to the polarity of the charged toner are applied to the back side of the recording paper 9, whereby the toner image is electrostatically transferred to the recording paper 9 by the image transfer unit 5 which is a corona charger.

In the image fixing process, heat or pressure is applied to the thus transferred toner image by the image fixing unit 6, so that the toner image is permanently fixed to the recording paper 9.

In the charge quenching process, the charges of the latent electrostatic image remaining on the surface of the photoconductor drum 1 after the above-mentioned image transfer process are quenched by the charge quenching unit 7.

In the cleaning process, the residual toner which remains on the surface of the photoconductor drum 1 without being transferred to the transfer paper 9 is removed therefrom by the cleaning unit 8.

In printers and facsimile apparatus, latent electrostatic images are usually formed on the surface of the photoconductor drum 1 by the application of laser beams.

Figure 2:
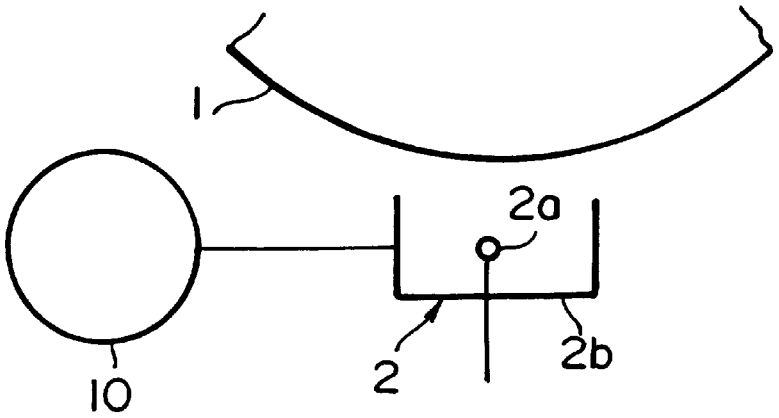
FIG. 2 is a schematic diagram in explanation of a corona charger of the present invention, which uses the corona charging method of the present invention.

FIG. 2 is a schematic diagram in explanation of a corona charger of the present invention, which uses the corona charging method of the present invention.

The corona charger of the present invention can be used as a charging device, for instance, for the charger 2, the image transfer unit 5 and the charge quenching unit 7 of the image formation apparatus shown in FIG. 1.

For instance, in the case of the charger 2, the charging device therefor is composed of a box-shaped charging house 2*b* and a charging wire 2*a* which is disposed within the charging house 2*b* and high voltage is applied across the charging wire 2*a* and the photoconductor drum 1.

The charging house 2*b* is composed of a side wall and a bottom plate, with an upper opening which is open toward the photoconductor drum 1. A non-ozone-generating gas source 10 is connected to the charge housing 2*b*, so that a non-ozone-generating gas can be supplied to the charging house 2*b* from the non-ozone-generating gas source 10.

As the non-ozone-generating gas, carbon dioxide is used. Since the specific gravity of carbon dioxide is greater than that of air, carbon oxide can stay long in the charging house 2*b* and form a stable ozone-generation hindering atmosphere composed of carbon dioxide, without supplying carbon dioxide continuously thereto.

In the above, the case where the corona charger is used in the above-mentioned corona charger 2 is explained. However, the same corona charger can be used in the image transfer unit 5, and the charge quenching unit 7 in the same manner as mentioned above.

It may be considered that as the non-ozone-generating gas, nitrogen can be used since nitrogen is the main component of air and easily available. However, the gas density of nitrogen is so close to the gas density of oxygen that nitrogen quickly diffuses in the air. Therefore, if nitrogen is used as the non-ozone-generating gas, it must be constantly supplied in order to maintain a ozone-generation hindering atmosphere consisting of nitrogen. As a matter of course, a special nitrogen supply apparatus will be required for constantly supplying nitrogen.

Japanese Laid-Open Patent Application 60-95459 discloses that corona charging conducted in an atmosphere of nitrogen produces $NO_x$, so that it is known that the hygroscopicity of a photoconductor is significantly increased when the photoconductor is exposed to the thus produced $NO_x$ and the increased hygroscopicity causes the charging performance of the photoconductor to deteriorate significantly.

It may also be considered that as the non-ozone- generating gas, for instance, water vapor $H_2O$, hydrogen gas $H_2$, rare gases such as He, Ne, propane gas $C_3H_8$, and natural gas $CH_4$ appear usable. As a matter of course, gases which catch fire cannot be used, and materials which are not in the state of a gas at room temperature cannot be used, either.

Rare gases, such as He, Ne, Ar and Xe, are not preferable to be used in practice, because high corona charging efficiency cannot be obtained in the presence of such rare gases, and such rare gases themselves are expensive.

If the non-ozone-generating gas is lighter than air, some means for holding the gas in the charging house 2*b* or some container for holding the gas will be required, or the gas must be continuously supplied to the charging house 2*b*. Therefore gases that are lighter than air are not preferable for use in the present invention even if the gases do not generate ozone in the corona charging conditions.

From this point of view, carbon dioxide is a suitable gas for use in the present invention.

As the non-ozone-generating gas for use in the present invention, gases with a molecular structure free of oxygen are preferable. From this point of view, carbon dioxide contains oxygen atoms in the molecular structure thereof, but the molecule of carbon dioxide is so stable that carbon dioxide is used as a fire-extinguishing agent and therefore does not release oxygen atoms under normal corona charging conditions, but can be sufficiently ionized under normal corona charging conditions.

The molecular weight of carbon dioxide is 44, and the specific gravity of carbon dioxide gas is about 1.5 times greater than the specific gravity of air, so that when carbon dioxide is placed in the above-mentioned charging house 2*b*, it stays at the bottom, with the air in the charging box 2*b* being replaced by carbon dioxide. Therefore, unlike nitrogen gas and helium gas, carbon dioxide gas does not diffuse quickly, but can be held long in a box like the above-mentioned charging house 2*b* if only the side and bottom portions are tightly sealed.

If the concentration of carbon dioxide is decreased below a desired level in the course of corona charging, carbon dioxide gas can be easily supplied to the charging house 2*b*, full to the brim, for instance, by adding carbon dioxide from a carbon dioxide holding cylinder until carbon dioxide gas overflows from the charging house 2*b*.

The carbon dioxide gas used in the present invention is easily available from an already existing conventional carbon dioxide source and it is not necessary to produce carbon dioxide for use in the corona charging apparatus of the present invention, so that the use of carbon dioxide for the present invention will not have adverse effects on the environmental conditions, such as "global warming".

Other features of this invention will become apparent in the course of the following description of exemplary embodiments, which are given for illustration of the invention and are not intended to be limiting thereof.

EXAMPLE 1

The relationship between the applied voltage and the corona charging current in the atmosphere of air and also the relationship in the atmosphere of carbon dioxide gas were investigated, using a charging potential measurement apparatus, a Paper Analyzer ("SP-428" made by Kawaguchi Electric Works Co., Ltd.), provided with a box-shaped charging house. The results are shown in FIG. 3.

Figure 3:
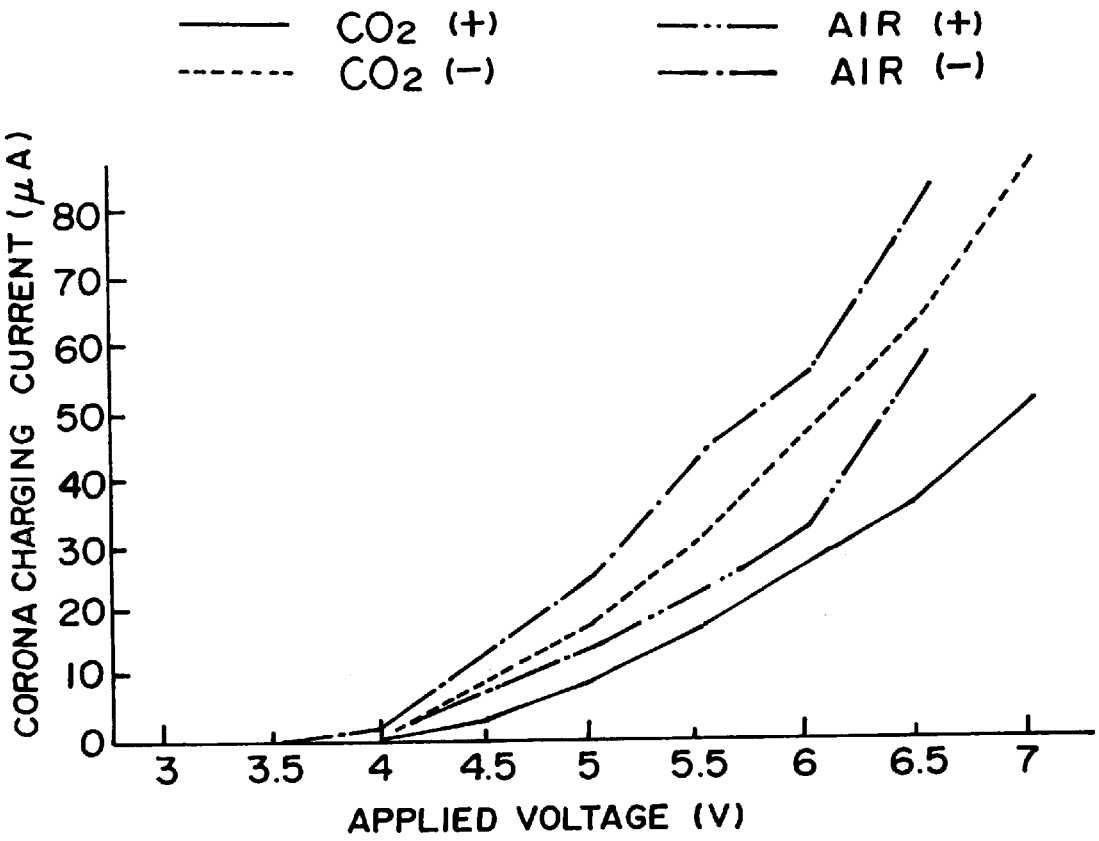
FIG. 3 is a graph showing the relationship between an applied voltage and a corona charging current in the atmosphere of air and also the relationship in the atmosphere of carbon dioxide gas.

As shown in FIG. 3, the corona charging did not initiate in the atmosphere of carbon dioxide unless the applied voltage was larger than the voltage applied in the atmosphere of air. However, when the applied voltage was sufficiently high, the corona charging was stable in the atmosphere of carbon dioxide.

In the course of the corona charging in the atmosphere of air, a pungent odor of ozone was emitted from the charging house, and the odor was stronger in a negative corona charging than in a positive corona charging. However, in the course of the corona charging in the atmosphere of carbon dioxide, such an unpleasant odor was not emitted.

In the corona charging in the atmosphere of air, 2 ppm of ozone was detected by an ozone concentration tester, but in the corona charging in the atmosphere of carbon dioxide, the detected concentration of ozone was only 0.005 ppm or less.

Furthermore, the following was confirmed. In the case of the corona charging in the atmosphere of carbon dioxide, the corona charging current was constant as long as carbon dioxide was supplied, and even if the supplying of carbon dioxide was stopped, the corona charging current did not increase for many hours. Even if the corona charging current began to increase, it took more hours before the corona charging current reached the same level as that of the corona charging current in the corona charging conducted in the atmosphere of air.

EXAMPLE 2

By use of the same charging potential measurement apparatus as used in Example 1, the charging potential, sensitivity, and residual potential of each of a Se photoconductor, a SeAs photoconductor, and an organic photoconductor comprising a charge generation layer composed of an azo pigment were investigated in the atmosphere of air and also in the atmosphere of carbon dioxide.

The applied voltage was set so as to produce the same charging current both in the atmosphere of air and in the atmosphere of carbon dioxide with respect to each photoconductor which was not charged (the applied voltage in the atmosphere of carbon dioxide was about 1.5 times the applied voltage in the atmosphere of air).

The illuminance for the measurement of the photosensitivity was the same both in the atmosphere of carbon dioxide and in the atmosphere of air. The exposure was the same with respect to the same photoconductor. TABLE 1 shows the conditions for the above measurements.

TABLE 1

| | Charging Applied Current ($\mu$A) | Illuminance for Exposure (lux) |
|---|---|---|
| Se photoconductor | +23 | 101 |
| SeAs photo-conductor | +23 | 11 |
| Organic Photoconductor | −23 | 51 |

The results are shown in TABLE 2.

TABLE 2

| Kind of P.C. | Kind of gas | Vm (V) | RD | $E_{1/10}$ (lux · sec) | Vr (V) |
|---|---|---|---|---|---|
| Se | Air | 1300 | 0.95 | 15.7 | 0 |
| Se | $CO_2$ | 1300 | 0.96 | 16.0 | 0 |
| $As_2Se_3$ | Air | 1250 | 0.88 | 2.6 | 0 |
| $As_2Se_3$ | $CO_2$ | 1240 | 0.87 | 2.5 | 0 |
| OPC | Air | 1350 | 0.98 | 1.3 | 5 |
| OPC | $CO_2$ | 1350 | 0.98 | 1.4 | 4 |

(Note)
"P.C." denotes photoconductor.
"Vm (V)" denotes the potential of the photoconductor after being charged for 20 seconds.
"RD" denotes the value obtained by dividing the potential of the photoconductor after 20 second dark decay by the initial potential thereof.
"$E_{1/10}$ denotes the light quantity required to reduce the potential by exposure to 1/10 the potential before exposure.
"Vr" denotes the residual potential of the photoconductor after 30 second exposure.

EXAMPLE 3

Figure 4:
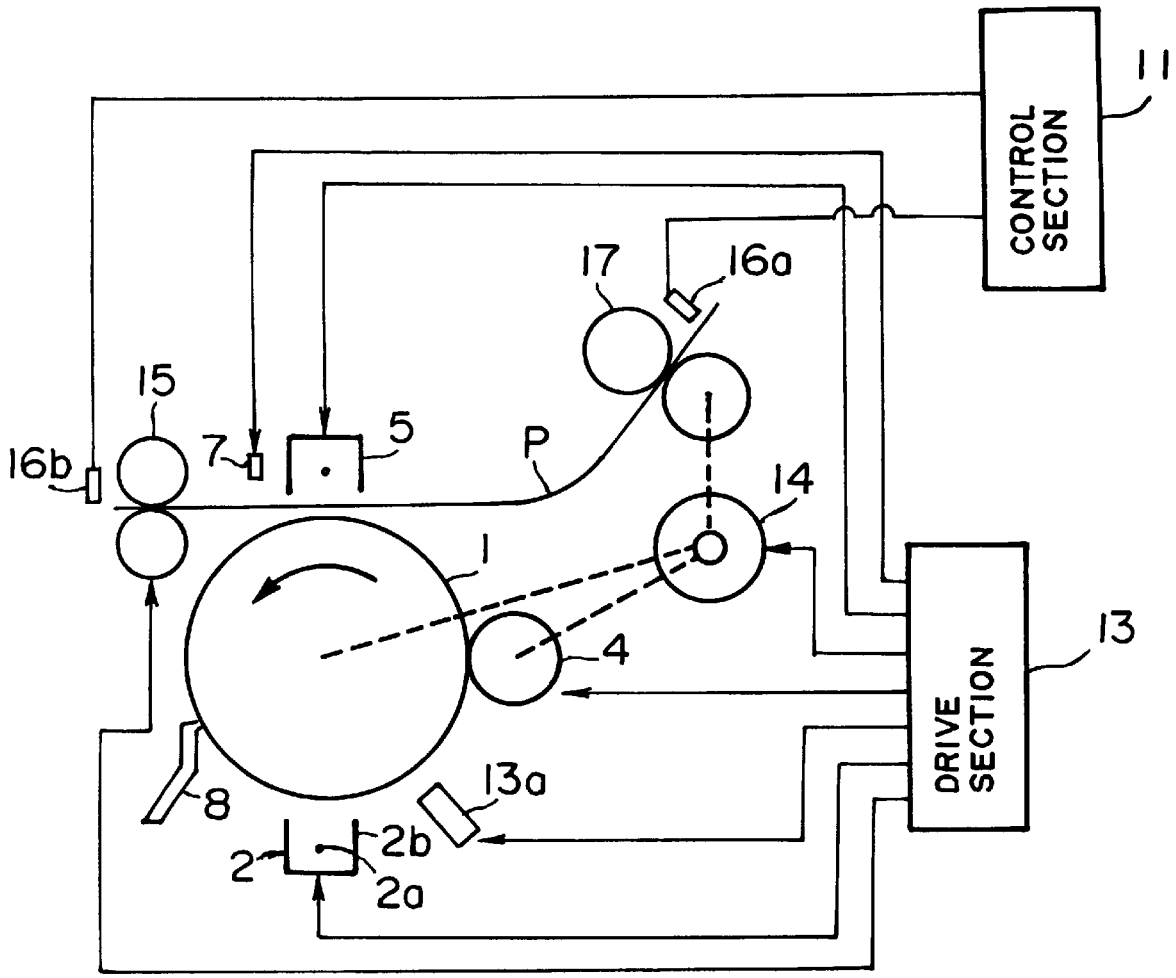
FIG. 4 is a schematic diagram of an image formation apparatus of the present invention.

FIG. 4 is a schematic diagram of an image formation apparatus of the present invention used in this example.

The image formation apparatus shown in FIG. 4 comprises a charger 2 which charges a photoconductor drum 1 which is a chargeable member, an exposure writing unit 13*a* by which the surface of the photoconductor drum 1 is exposed to a light image to form a latent electrostatic image on the photoconductor drum 1, a development unit 4 for developing the latent electrostatic image formed on the surface of the photoconductor drum 1 to a visible toner image, an image transfer unit 5 for transferring the developed toner image to a transfer sheet 9, and a control section 11 which automatically starts the operation of this image formation apparatus in response to image formation or printing start signals and terminates the operation after image formation or printing. The above-mentioned charger 2 is situated below the photoconductor drum 1 and is provided with a box-shaped charging house 2*b* having an upper opening 2*h* which is disposed in vicinity to and directed to the photoconductor drum 1 (refer to FIGS. 6A and 6B). The box-shaped charging house 2*b* also serves as charging atmosphere gas holding means for holding an charging atmosphere gas which is a non-ozone-generating gas having a specific gravity greater than that of air.

Figure 6A:
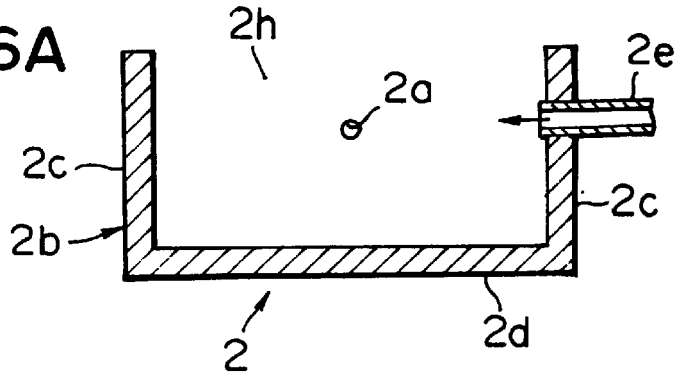
FIG. 6A is a schematic cross-sectional view of a charging house of a corona charger of the present invention, in which a pipe is connected to a central portion of a side wall of the charging house.

As illustrated in FIG. 6A, the charging house 2*b* of the charger 2 is constructed so as to surround the side and the bottom portion of a charging wire 2*a*, using a side plate 2*c* and a bottom plate 2*d*. As mentioned above, the upper opening 2*h* is formed so as to be directed toward the photoconductor drum 1.

Figure 5:
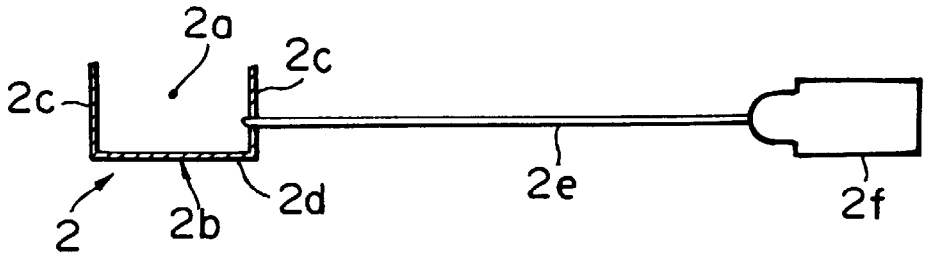
FIG. 5 is a schematic diagram in explanation of the supply of a gas from a gas supply cylinder through a supply pipe to a corona charging house.

To a central portion of the side plate 2*c* of the charging house 2*b* is connected one end portion of a pipe 2*e*, and to the other end of the pipe 2*e* is connected a cylinder 2*f* in which carbon dioxide is filled with high pressure, serving as charging atmosphere gas supply means as illustrated in FIG. 5. The filled carbon dioxide serves as the charging atmosphere gas. The charging atmosphere gas is supplied to the charging house 2*b* from the cylinder 2*f* through the pipe 2*e*, and corona charging is carried out with the application of a voltage to the charging wire 2*a*.

At this moment, since only the upper portion of the corona charger 2 is open, carbon dioxide which has a specific gravity larger than that of air stays in the corona charger 2 for a long time, so that it is unnecessary to supply carbon dioxide to the corona charger 2 frequently. Furthermore, since the cylinder 2*f* serving as charging atmosphere gas supply means is provided, even if the charging atmosphere gas is dispersed, the charging atmosphere gas can be supplied whenever necessary, so that stable corona charging and stable charging of the photoconductor drum 1 can be carried out. In particular, when the cylinder 2*f* is provided as in Example 3, the replacement of charging atmosphere gas supply source is extremely easy.

In the above-mentioned charger 2, the charging house 2*b* is filled with the carbon dioxide by causing the carbon dioxide to flow into the charging house 2*b* through the pipe 2*e*, and then corona charging is carried out with the application of a predetermined voltage through a high voltage power source, whereby the photoconductor drum 1 is charged to reach a predetermined surface potential. The thus charged photoconductor drum 1 was exposed to a light image of an original to be copied through the exposure writing unit 13*a*, whereby a latent electrostatic image is formed on the photoconductor drum 1. The thus formed latent electrostatic image is then developed by toner to a visible toner image by the toner being deposited on the latent electrostatic image, using the development unit 4. The thus developed toner image is then transferred to an image transfer paper P. The thus transferred toner image is then fixed to the image transfer paper P by being passed between a pair of image fixing rollers 15 as will be explained later, whereby the desired toner image can be formed.

Figure 6B:
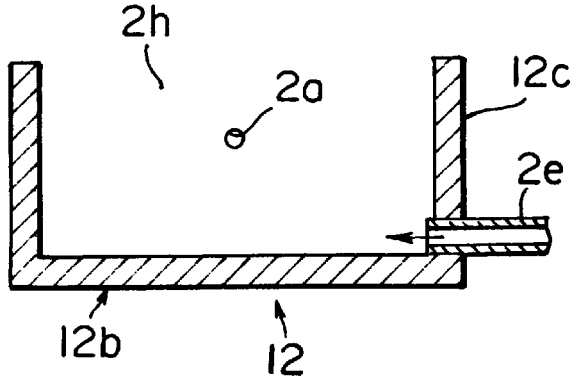
FIG. 6B is a schematic cross-sectional view of a charging house of a corona charger of the present invention, in which a pipe is connected to a lower portion of a side wall of the charging house.

As illustrated in FIG. 6B, the one end portion of the pipe 2*e* which is to be connected to the charging house 12*b* of the charger 12 may be connected to a lower end portion of the side plate 12*c*, so that the charging atmosphere gas is caused to overflow from the upper opening 2*h*.

Figure 6C:
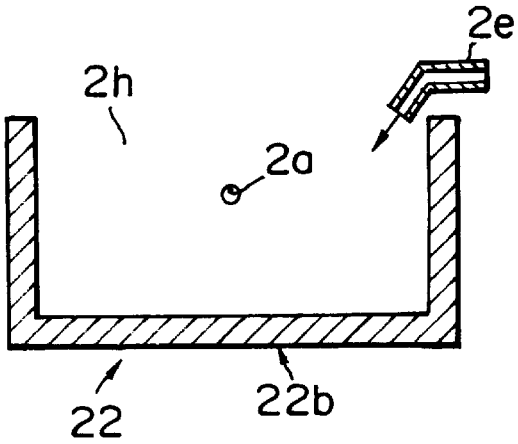
FIG. 6C is a schematic cross-sectional view of a charging house of a corona charger of the present invention, to which a non-ozone-generating gas is supplied from an upper opening of the charging house.

Furthermore, as illustrated in FIG. 6C, the charging atmosphere gas may be supplied from above the upper opening 2*h* of a charging house 22*b* of a charger 22 through the pipe 2*e* in such a manner that the charging house 22*b* is filled with the charging atmosphere gas and the charging atmosphere gas is then caused to overflow from the charging house 22*b*.

Figure 6D:
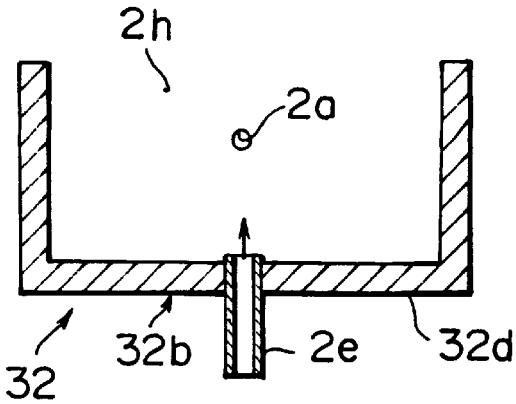
FIG. 6D is a schematic cross-sectional view of a charging house of a corona charger of the present invention, in which a pipe is connected to a central portion of a bottom plate of the charging house.

Furthermore, as illustrated in FIG. 6D, the one end portion of the pipe 2*e* which is to be connected to a charging house 32*b* of a charger 32 may be connected to a central portion of a bottom plate 32*d*, so that the charging atmosphere gas is caused to overflow from the upper opening 2*h*.

In the charging house 12 illustrated in FIG. 6B, and also in the charging house 32 illustrated in FIG. 6D, the charging atmosphere gas supply means is connected to the bottom of the charging atmosphere gas holding means, the charging atmosphere can be supplied efficiently.

The image formation apparatus in Example 3 is also provided with a light charge quencher 7 comprising an LED (light emission diode) for quenching charges on the photoconductor drum 1, a cleaner 8 for cleaning the surface of the photoconductor drum 1, a transport roller 17 for transporting the image transfer paper P, an image fixing roller 15 for fixing the toner image on the image transfer paper P to which the toner image has already been transferred as the transfer paper P is being transported, a stand-by sensor 16*a* for detecting the arrival of the transfer paper P at the transport roller 17 which is a stand-by position from a hopper (not shown), a discharge sensor 16*b* for detecting the discharge of the transfer paper P, and a motor 14 which drives in rotation, for instance, the transport roller 17, the photoconductor drum 17, the development unit 4 and the image fixing roller 15.

The light charge quencher 7, the image transfer unit 5, the motor 14, the development unit 4, the exposure writing unit 13*a*, the charger 2 and the image fixing roller 15 are energized by a drive section 13.

The operation of the image formation apparatus in Example 3 will now be explained.

When a copying operation is initiated, the reading of image data is started by a scanner (not shown). Based on the image data, light-writing and the formation of a latent electrostatic image are started, using laser beams by the exposure writing unit 13*a*. A toner image formed on the photoconductor drum 1 is transferred to the image transfer paper P transported by the transport roller 17 by the image transfer unit 5. The toner image transferred to the image transfer paper P is then fixed thereto by the image fixing roller 15. After the image transfer, charges remaining on the surface of the photoconductor drum 1 are quenched by the charge quencher 7, and the surface of the photoconductor drum 1 is cleaned by the cleaner 8.

Image formation was conducted with the charging house 2*b* being filled with carbon dioxide serving as the charging atmosphere gas so as to replace the air in the charging house 2*b* being replaced by carbon dioxide, under the application of a predetermined voltage to the charger 2. High quality images were obtained, without the emission of the odor of ozone being from the image formation apparatus.

The corona charger used as the charger 2 in Example 3 can also be used in the image transfer unit and/or in the charge quenching unit as well.

EXAMPLE 4

Figure 7:
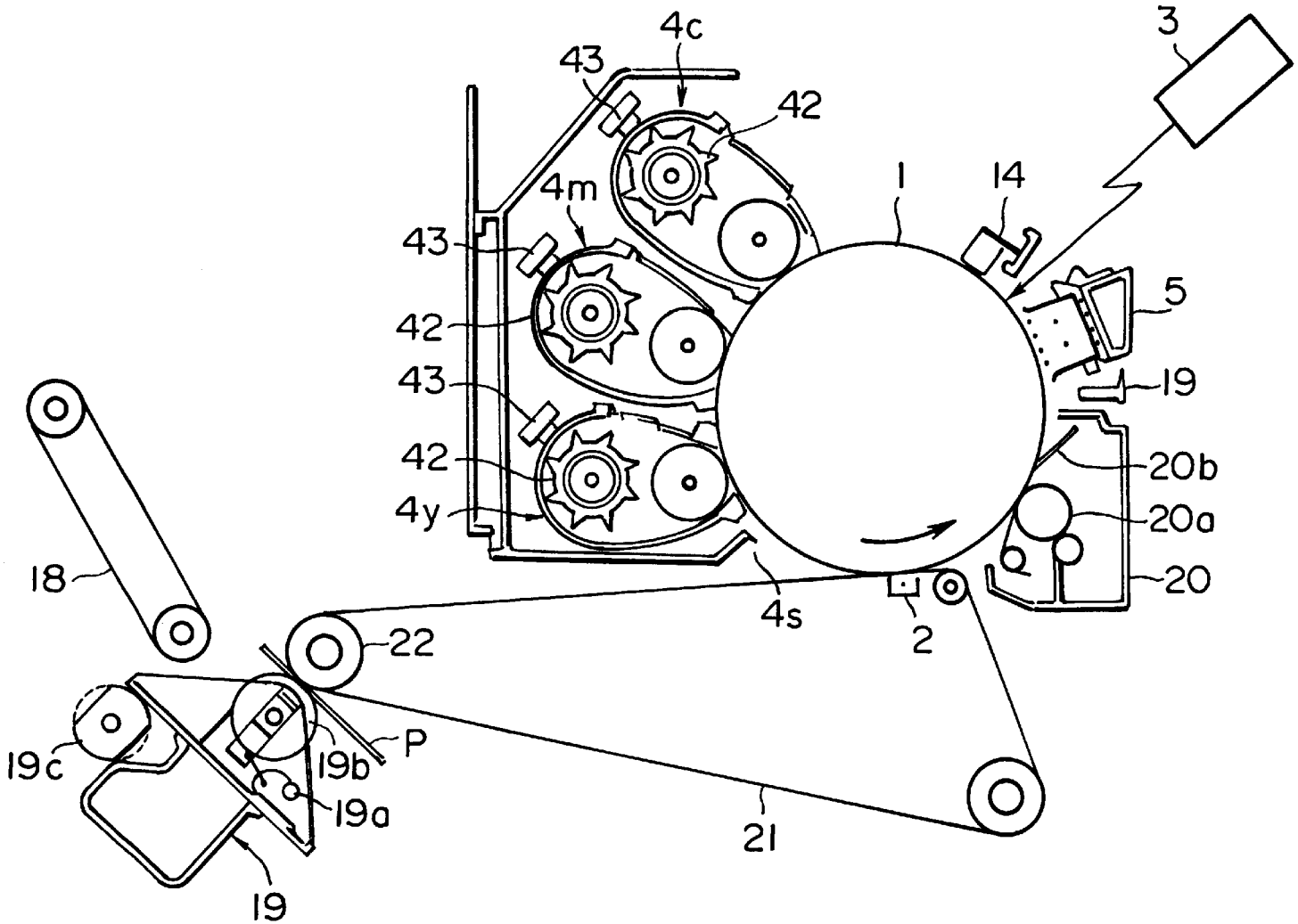
FIG. 7 is a schematic cross-sectional view of an image formation apparatus of the present invention, using an intermediate image transfer belt.

With reference to FIG. 7, an image formation apparatus used in Example 4 will now be explained.

The photoconductor drum 1 is rotated counter-clockwise in the direction of the arrow. Around the photoconductor drum 1, there are situated a photoconductor cleaning unit 20, a charge quenching lamp 19, a charger 5 for uniformly charging the surface of the photoconductor drum 1, a light image writing unit 3, a potential sensor 14, a development unit 4*c* for cyan out of three primary colors (cyan, magenta, and yellow), a development unit 4*m* for magenta, a development unit 4*y* for yellow, a developed density pattern detector 4*s*, an image transfer unit 2, an intermediate image transfer belt 21 which is disposed below the photoconductor drum 1, and a roller 22. Each of the development units 4*c*, 4*m* and 4*y* comprises a development sleeve 41 which is rotated so as to deposit each developer on the surface of the photoconductor drum 1 in order to develop a latent electrostatic image, a development paddle 42 which is rotated to scoop up and stir the developer, and a toner concentration sensor 43 for monitoring the concentration of the toner in the developer.

Inside the intermediate image transfer belt 21, there is disposed the charging house 2*b* of the image transfer unit 2 (refer to FIG. 5 and FIG. 6) so as to be directed to the photoconductor drum 1.

In the same manner as in Example 3, there is formed a hole in the side wall 2*c* of the box-shaped charging house 2*b* (refer to FIG. 5 and FIG. 6), through which hole the charging atmosphere gas is supplied. The pipe 2*e* is connected to the hole and the charging atmosphere gas is supplied through the pipe 2*e* from the charging atmosphere gas supply cylinder 2*f*. In this image formation apparatus, as the charging atmosphere supply means, the above-mentioned charging atmosphere gas supply cylinder 2*f* in which the charging atmosphere gas is filled with high pressure, so that the replacement of the charging atmosphere supply means is easy. Further, as in Example 3, in place of the charger 2 shown in FIG. 6A, the chargers 12, 22 or 32, which are respectively shown in FIG. 6B, FIG. 6C and FIG. 6D, can be employed.

The image formation procedure will now be explained, taking as an example the case where the development is carried out in the order of cyan, magenta and yellow, although the development is not always limited to this order.

When a copying operation is initiated, the reading of a cyan image data is started by a color scanner (not shown) with a predetermined timing. Based on the cyan image data, light-writing and the formation of a latent electrostatic image for cyan are started, using laser beams. The development sleeve 41 then begins to be rotated before the leading edge of the latent electrostatic image for cyan reaches the development position of the development unit 4*c* for cyan, in order that the development of the latent electrostatic image for cyan can be carried out from the leading edge onto the rear edge thereof without fail. Thus, the latent electrostatic image for cyan is developed with a cyan toner to a cyan toner image down to the rear edge of the latent electrostatic image. When the rear edge of the latent electrostatic image for cyan has passed the cyan development position, further development becomes inoperable. This step is completed at latest before the latent electrostatic image for magenta reaches the development position for magenta of the development unit 4*m* in response to the subsequent magenta image data.

The cyan toner image formed on the photoconductor drum 1 is then transferred to the surface of the intermediate image transfer belt 21 which is rotated at the same speed as that of the photoconductor drum 1. This image transfer is carried out, using the charger 2 provided with an opening directed upward toward the photoconductor drum 1. The above-mentioned cyan toner image, a magenta toner image and a yellow toner image, which are successively formed on the photoconductor drum 1, are transferred to the intermediate image transfer belt 21 in a superimposed manner with a predetermined positional registration to form a three-color superimposed toner image on the intermediate image transfer belt 21. The thus formed three-color superimposed toner image is then collectively transferred from the intermediate image transfer belt 21 to an image transfer paper P.

An image transfer unit 19 for transferring the three-color superimposed toner image to the image transfer paper P comprises an image transfer bias roller 19*b*, a roller cleaning blade 19*a*, and an attachment and detachment mechanism 19c for attaching the image transfer bias roller 19 to and detaching the image transfer bias roller 18 from the intermediate image transfer belt 21. The image transfer bias roller 19*b* is normally detached from the surface of the intermediate image transfer belt 21. However, when the three-color superimposed toner image is collectively transferred from the intermediate image transfer belt 21 to the image transfer paper P, the image transfer bias roller 19*b* is urged toward the intermediate image transfer belt 21 with a predetermined timing by the attachment and detachment mechanism 19*c*, and the toner image is transferred to the image transfer paper P while a predetermined bias voltage is applied thereto by the image transfer bias roller 19*b*. In FIG. 7, reference numeral 18 indicates a paper transfer unit; reference numeral 22, a cleaning unit for cleaning the photoconductor 1; reference numeral 20*a*, a brush roller; 20*b*, a rubber blade.

For comparison, instead of the image transfer method with the application of a voltage to the intermediate image transfer belt 21 as in Example 4, a conventional image transfer method using an electroconductive roller with the application of a voltage for image transfer thereto was used.

The result was that the quality of images obtained in Example 4 was as excellent as that of images obtained in the above-mentioned method. The image transfer system employed in Example 4 has the advantages over the above-mentioned conventional method that the mechanism of the image transfer system in Example 4 is much more simplified in comparision with the mechanism of the conventional system since no rotation mechanism for rollers are required in the system in Example 4, and that therefore, non-uniformity in the quality of images obtained is significantly reduced at high speed copying operation.

In Example 4, the corona charger is used in the image transfer unit, but the same corona charger can also be easily applied to a charge quenching unit.

Figure 8:
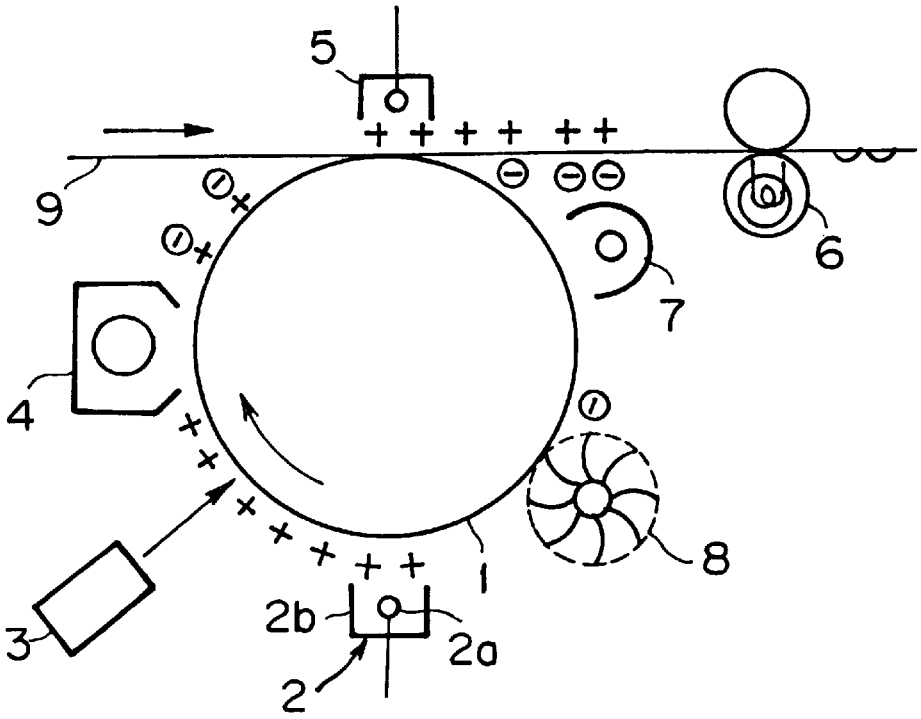
FIG. 8 is a schematic diagram in explanation of the structure of an image formation apparatus of the present invention.

FIG. 8 is a schematic diagram of an image formation apparatus of the present invention.

With reference to this diagram, the image formation apparatus of the present invention will now be explained. As shown in FIG. 8, the image formation apparatus of the present invention comprises a photoconductor drum 1 comprising a drum-shaped photoconductor made of Se and a Se alloy, zinc oxide, cadmium sulfide or an organic photoconductor, a charger 2 for uniformly charging the surface of the photoconductor drum 1, an exposure unit 3 for forming a latent electrostatic image on the surface of the photoconductor drum 1, a development unit 4 for developing the latent electrostatic image formed on the photoconductor drum 1 to a visible toner image, an image development unit 5 for transferring the developed toner image to a recording paper 9, an image fixing unit 6 for permanently fixing the transferred toner image to the recording paper 9, a charge quenching unit 7 for quenching the charges of the latent electrostatic image on the photoconductor drum 1, and a cleaning unit 8 for cleaning the surface of the photoconductor drum 1 by removing a residual toner therefrom.

In the recording process in this image formation apparatus, first of all, the surface of the photoconductor drum 1 is uniformly charged in the dark in a charging process.

In an exposure process, the uniformly charged surface of the photoconductor drum 1 is exposed to a light image by the exposure unit 3, so that the charges in the portions exposed to the light of the light image on the surface of the photoconductor drum 1 are caused to dissipate away, while the charges in the portions which are not exposed to the light of the light image, corresponding to the image area of the light image, on the surface of the photoconductor drum 1 remain, whereby a latent electrostatic image corresponding to the light image is formed on the surface of the photoconductor drum 1.

In a development process, colored fine particles which are charged to a polarity opposite to the polarity of the latent electrostatic image (that is, a so-called toner) are deposited on the latent electrostatic image by the development unit 4, whereby the latent electrostatic image is developed into a visible toner image.

In an image transfer process, the recording paper 9 is superimposed on the visible toner image, and charges with a polarity opposite to the polarity of the charged toner are applied to the back side of the recording paper 9, whereby the toner image is electrostatically transferred to the recording paper 9 by the image transfer unit 5 which is a corona charger.

In an image fixing process, heat or pressure is applied to the thus transferred toner image by the image fixing unit 6, so that the toner image is permanently fixed to the recording paper 9.

In a charge quenching process, the charges of the latent electrostatic image remaining on the surface of the photoconductor drum 1 after the above-mentioned image transfer process are quenched by the charge quenching unit 7.

In a cleaning process, the residual toner which remains on the surface of the photoconductor drum 1 without being transferred to the transfer paper 9 is removed therefrom by the cleaning unit 8.

By repeating a series of the above-mentioned charging process, exposure process, development process, image transfer process, image fixing process, charge quenching process, and cleaning process, image formation or printing process is repeatedly carried out.

In printers and facsimile apparatus, latent electrostatic images are usually formed on the surface of the photoconductor drum 1 by the application of laser beams.

Figure 9:
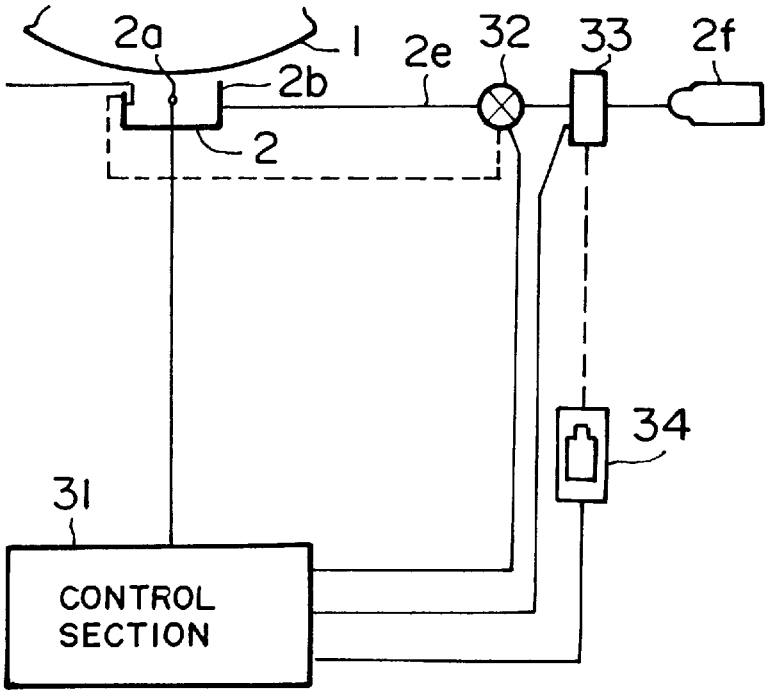
FIG. 9 is a schematic diagram in explanation of a charging atmosphere supply apparatus for a corona charging charger which is provided in the image formation apparatus of the present invention.

FIG. 9 is a schematic diagram in explanation of a charging atmosphere supply apparatus for a corona charging apparatus which is provided in the image formation apparatus of the present invention.

This corona charging apparatus can be used as a corona charger for use in the charger, the image transfer unit, and the charge quenching apparatus for the image formation apparatus shown in FIG. 8.

This corona charger, when used as the charger 2, is provided with a box-shaped charging house 2*b* and a charging wire 2*a* which is disposed within the charging house 2*b*. A high voltage is applied across the charging wire 2*a* and the photoconductor drum 1.

The charging house 2*b* is composed of a side wall and a bottom wall, with an upper opening directed toward the photoconductor drum 1. A cylinder 2*f* which holds therein a non-ozone-generating gas is connected to the charging house 2*b* via a pipe 2*e*, so that the non-ozone-generating gas can be supplied to the charging house 2*b*. The pipe 2*e* is provided with a gas flow adjustment valve 32 and a a pressure meter or a flow sensor 33 between the charging house 2*b* and the cylinder 2*f*. The charging house 2*b* is also provided with a warning sign display panel 34 and a control section 31.

In the above-mentioned structure, the charging house 2*b*, which is charging atmosphere gas holding means, includes an upper opening directed to the photoconductor drum 1 (which is a chargeable member), so that the charging house 2*b* can hold therein the charging atmosphere gas having a larger specific gravity than that of air for a long time, and accordingly it is unnecessary to supply the non-ozone-generating gas to the charging house 2*b* frequently.

The above-mentioned gas flow adjustment valve 32 is opened or closed so as to adjust the flow of the non-ozone-generating gas in response to the signal output from a gas sensor provided within the charging house 2*b*.

Figure 12A:
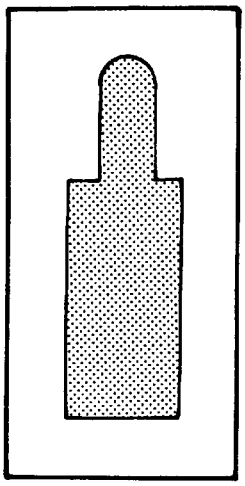
FIGS. 12A and 12B are each a plan view of a warning display panel for use in the image formation apparatus of the present invention.
Figure 12B:
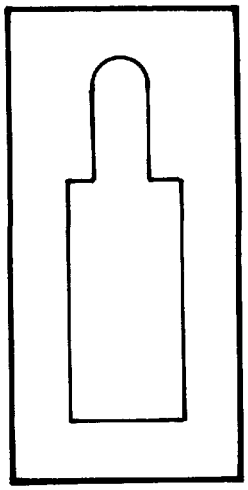

The above-mentioned sensor 33 detects the pressure of the gas or the flow of the gas within the pipe 2*e* and ouputs a signal for the instruction of the timing of the replacement of the cylinder 2*f* to the control section 31, whereby the warning sign display panel 34 is lighted on as shown FIG. 12A. FIG. 12B shows a turned-off state of the warning sign display panel 34.

The control section 31 outputs a signal for instructing the application of a voltage to the charging wire 2*a* after the replacement of the cylinder 2*f*.

Figure 10:
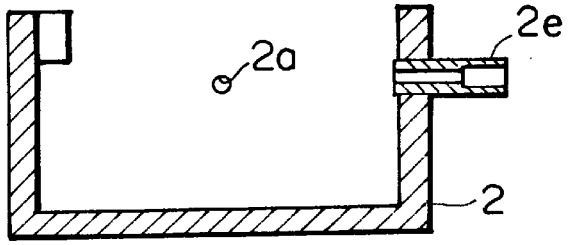
FIG. 10 is a schematic cross-sectional view of a corona charger which is provided in the image formation apparatus of the present invention.

FIG. 10 is a schematic cross-sectional view of a corona charger, which is composed of a side wall and a bottom plate, with an upper portion being opened, in which the charging wire 2*a* is surrounded by the side wall and the bottom plate. The pipe 2*e* is connected to the side wall as illustrated in FIG. 10.

Figure 11A:
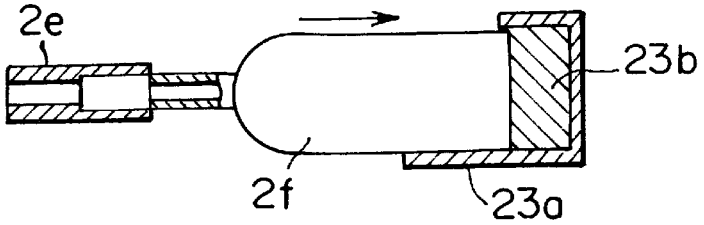
FIGS. 11A and 11B are each a cross-sectional view of a gas cylinder for use in the image formation apparatus of the present invention, in explanation of the connection of the gas cylinder.
Figure 11B:
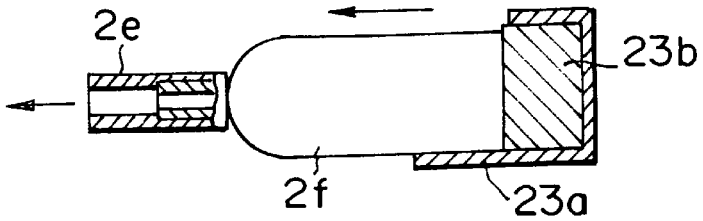

FIGS. 11A and 11B are schematic cross-sectional views of the cylinder 2*f* in explanation of the connection thereof. The cylinder 2*f* is set between the pipe 2*e* and a holder 23. When setting the cylinder 2*f*, since an elastic member 23*b* is placed within the holder 23*a*, the cylinder 2*f* is set in such a manner so as to depress the elastic member 23*b*.

When the cylinder 2*f* pushed so as to depress the elastic material 23*b* is released, the cylinder 2*f* is brought into pressure contact with one end portion of the pipe 2*e* by the repulsion of the elastic member 23*b*, so that the cylinder 2*f* is automatically opened as shown in FIG. 11B. Thus, the cylinder 2*f* can be easily attached or detached by one touch operation.

EXAMPLE 5

Figure 13A:
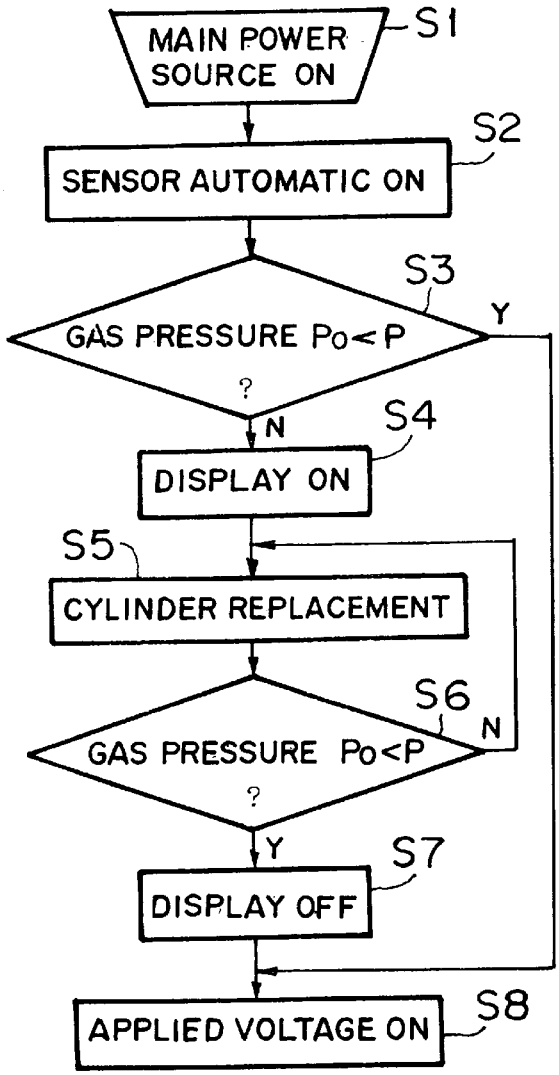
FIG. 13A is a flow diagram of a lighting procedure of a warning display panel for use in the image formation apparatus of the present invention, when a pressure sensor is employed.
Figure 13B:
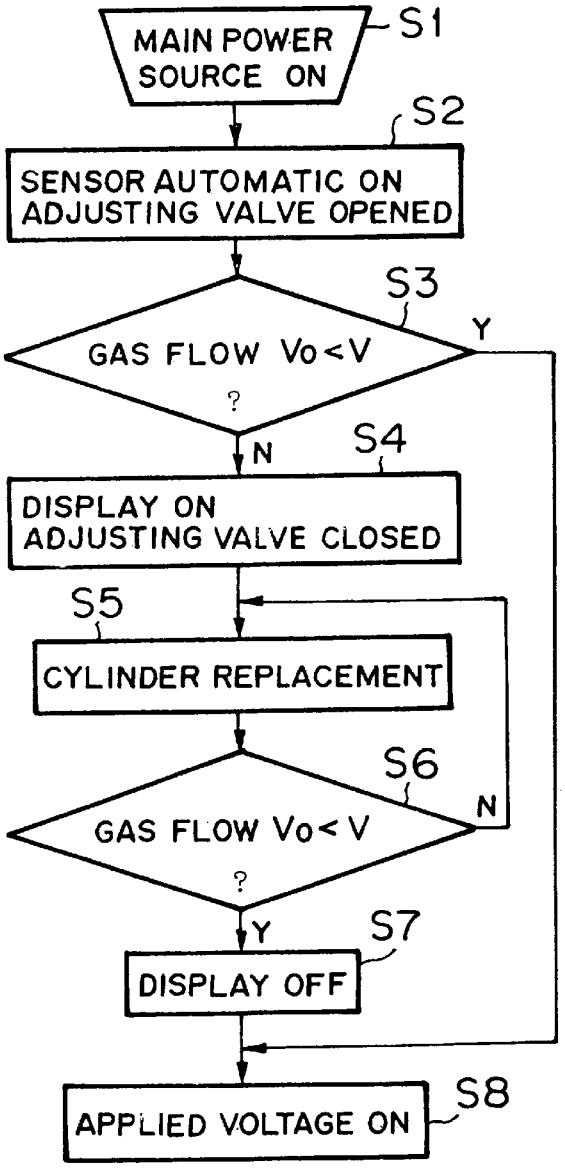
FIG. 13B is a flow diagram of a lighting procedure of a warning display panel for use in the image formation apparatus of the present invention, when a flow rate sensor is employed.

FIG. 13A and FIG. 13B are diagrams showing the flow of the light up procedure of the display panel 34. In particular, FIG. 13A is a flow diagram of the lighting procedure of the display panel 34 when a pressure sensor is employed, and FIG. 13B is a flow diagram of the lighting procedure of the display panel 34 when a flow rate sensor is employed.

As shown in FIG. 13A, a main power is turned ON in Step S1, a pressure sensor is automatically turned ON in Step S2, so that the detection of the pressure of the charging atmosphere gas within the cylinder 2*f* is initiated.

In Step S3, the pressure P detected by the pressure sensor is compared with a predetermined pressure $P_0$. When the detected pressure P is larger than the predetermined pressure $P_0$, this step proceeds to Step S8, and the charger is turned ON to apply the voltage to the charging wire thereof, which is labeled as "Applied Voltage ON" in the diagram of FIG. 13A. When the detected pressure P is equal to or smaller than the predetermined pressure $P_0$, this step proceeds to Step S4. When the above-mentioned pressure $P_0$ is set at the atmospheric pressure, it can be detected when the remaining amount of the gas in the cylinder 2*f* becomes zero. Alternatively, by setting the pressure $P_0$ at a pressure which is slightly higher than the atmospheric pressure, the display can be lighted so as to indicate "warning sign" when the remaining amount of the gas in the cylinder 2*f* is about to become zero before the remaining amount becomes completely zero.

In Step S4, the warning sign is lighted in the display, and the step proceeds to Step S5. In Step S5, the cylinder is replaced with a new cylinder filled with the non-ozone-generating gas.

In Step S6, the pressure P detected by the pressure sensor is compared with the predetermined pressure $P_0$. When the detected pressure P is larger than the predetermined pressure $P_0$, this step proceeds to Step S7, and the warning sign in the display is turned OFF. When the detected pressure P is equal to or smaller than the predetermined pressure $P_0$, this step goes back to Step S5. Therefore, the warning sign in the display is kept "turned ON" until the detected pressure exceeds the predetermined pressure $P_0$ after the replacement of the cylinder 2*f*. When the detected pressure exceeds the predetermined pressure $P_0$ afer the replacement of the cylinder 2*f*, the warning sign in the display is turned OFF.

Then a predetermined voltage is applied to the charging wire of the charger, which is labeled as "Applied Voltage ON" in the diagram of FIG. 13A.

In a commercially available copying machine (made by Ricoh Company, Ltd.), with the above-mentioned charger being installed, in which corona charging can be carried out in the atmosphere of carbon dioxide, to which carbon dioxide can be supplied when necessary, a pressure sensor is provided between the gas supply portion and a gas flow adjustment valve, and another pressure sensor in the charging section of the charger, and when the detected gas pressure reaches the atmospheric pressure or decreases below the atmospheric pressure, the display panel 14 is designed so as to turn ON a warning sign showing the decreased pressure.

In Example 5, the image quality initially obtained was excellent, and the display panel 34 was lighted when a predetermined number of copies was made. Therefore, the cylinder 2*f* was replaced with a cylinder 2*f* which was filled with carbon dioxide, and the copy making operation was continued. The result was that excellent image quality was continuously obtained.

When the copy making operation was continued without exchanging the cylinder 2*f* even though the display panel 34 was turned ON, the obtained image quality rapidly deteriorated with the image density increasing exceedingly.

EXAMPLE 6

In the case where the flow rate sensor is employed, as shown in FIG. 13B, a main power is turned ON in Step S1, a flow rate sensor is automatically turned ON in Step S2, so that the detection of the flow rate of the charging atmosphere gas within the cylinder 2*f* is initiated.

In Step S3, the flow rate V detected by the flow rate sensor is compared with a predetermined flow rate $V_0$. When the detected flow rate V is larger than the predetermined flow rate $V_0$, this step proceeds to Step S8, and the charger is turned ON to apply the voltage to the charging wire thereof, which is labeled as "Applied Voltage ON" in the diagram of FIG. 13B. When the detected flow rate V is equal to or smaller than the predetermined flow rate $V_0$, this step proceeds to Step S4.

In Step S4, the warning sign is lighted in the display, the flow rate adjustment valve 11 is closed and the step proceeds to Step S5. In Step S5, the cylinder is replaced with a new cylinder filled with the non-ozone-generating gas.

In Step S6, the flow rate V detected by the flow rate sensor is compared with the predetermined flow rate $V_0$. When the detected flow rate is larger than the predetermined flow rate $V_0$, this step proceeds to Step S7, and the warning sign in the display is turned OFF. When the detected flow rate V is equal to or smaller than the predetermined flow rate $V_0$, this step goes back to Step S5. Therefore, the warning sign in the display is kept "turned ON" until the detected flow rate exceeds the predetermined flow rate $V_0$ afer the replacement of the cylinder 2*f*. When the detected flow rate exceeds the predetermined flow rate $V_0$ afer the replacement of the cylinder 2*f*, the warning sign in the display is turned OFF.

Then a predetermined voltage is applied to the charging wire of the charger, which is labeled as "Applied Voltage ON" in the diagram of FIG. 13B.

In a commercially available copying machine (made by Ricoh Company, Ltd.), with the above-mentioned charger being installed, in which corona charging can be carried out in the atmosphere of carbon dioxide, to which carbon dioxide can be supplied when necessary, a flow rate sensor is provided between the gas supply portion and a gas flow adjustment valve, and another pressure sensor in the charging section of the charger, and when the detected flow rate becomes zero, the display panel 14 is designed so as to turn ON a warning sign showing that the flow rate becomes zero.

In Example 6, the image quality initially obtained was excellent, and the display panel 34 was lighted when a predetermined number of copies was made. Therefore, the cylinder 2*f* was replaced with a cylinder 2*f* which was filled with carbon dioxide, and the copy making operation was continued. The result was that excellent image quality was continuously obtained.

When the copy making operation was continued without exchanging the cylinder 2*f* even though the display panel 34 was turned ON, the obtained image quality rapidly deteriorated with the image density increasing exceedingly.

As described above, the excellent image quality was continuously obtained by replacing the cylinder 2*f* in accordance with the sign displayed on the display panel 34. However, when the sign displayed on the display panel 4 was ignored and the copying operation was continued, the image quality obtained deteriorated in the course of the continued copy making operation and eventually the odor of ozone was emitted from the charger.

It is known that when corona charging is employed, image blur and imbalance in color reproduction tend to occur and also that such image blur and imbalance in color reproduction appear to be caused by some luminescence phenomenon which is accompanied by corona charging. The light emitted in the course of the luminescence phenomenon which takes place during the corona charging in the atmosphere of air or argon is bluish.

Under such circumstances, the inventor of the present invention has discovered that the light emitted in the course of the luminescence phenomenon which takes place during the corona charging in the atmosphere of carbon dioxide is nearly white light. The inventor of the present invention has also discovered that the intensity of the light emitted in the course of the luminescence phenomenon caused by the corona charging in the atmosphere of carbon dioxide is smaller than the light emitted in the course of the luminescence phenomenon caused by the corona charging in the atmosphere of air or argon.

The above discovery is utilized in the present invention to provide high quality images.

When corona charging is conducted with the application of a certain voltage, for instance, using the above-mentioned charging wire, part of generated corona ions is deposited in the form of surface charges on the surface of the photoconductor, and part of the generated ions is combined with electrons or ions having a polarity opposite to the polarity of the generated corona ions. When part of the generated ions is combined with electrons or ions having a polarity opposite to the polarity of the generated corona ions, and when electrons discharged from an electrode are recombined, excessive energy is released in the form of light, and this luminescence phenomenon is referred to as corona phenomenon.

When the photoconducotor, which is a chargeable member, is exposed to light, the electric resistance thereof is reduced. Therefore, when a latent electrostatic image is formed on the photoconductor, the photoconductor must be protected from the exposure to extra light as much as possible.

It is known that the spectrum of a light emitted by the above-mentioned luminescence phenomenon differs depending upon the kind of the gas employed in the corona charging and that the color of the light emitted during the corona charging in the atmosphere of air (mostly $N_2$) and in the atmosphere of argon (Ar) is blue.

Conventionally, however, such luminescence phenomenon has not been raised as a problem, since the image quality required so far is such that the above-mentioned luminescence phenomenon is not a problem. However, recently extremely high image quality is demanded, and accordingly photoconductors with extremely high photosensitivity are used for high speed image formation, so that the effect of slight light including the above-mentioned luminescence phenomenon becomes a problem with respect to the photoconductors with extremely high photosensitivity.

In an analog copy making operation, the spectral sensitivity of a photoconductor to be used is unquestionably important. However, the above-mentioned light emitted by the above-mentioned luminescence phenomenon is superimposed on the light from an exposure light source, which is reflected by an original document to be copied. Therefore, when the light emitted by the luminescence phenomenon has a particular wavelength, the density of a color tone corresponding to the light is decreased in a positive-positive (PP) system, while in a negative-positive (NP) system, the density is increased, so that the imbalance of the color tone is caused in the reproduction thereof when a colored original is copied.

In contrast to this, carbon dioxide, when used as the charging atmosphere gas in corona charging, is panchromatic, free of a particular spectral distribution, in this sense, and emits white light. The intensity of the light emitted from carbon dioxide during corona charging is smaller than that of the light emitted from an inert gas such as argon during corona charging, so that the problems of the formation of blurred images and the imbalance of color reproduction from a colored original can be avoided by use of carbon dioxide as the charging atmosphere gas in corona charging.

EXAMPLE 7

In an analog type image formation apparatus, using a light source emitting white light, as shown in FIG. 4, which was used in Example 3, carbon dioxide was used as the charging atmosphere gas, and a toner for use in a low potential development was used, and also a photoconductor comprising a 20 $\mu$m thick amorphous silicon photoconductive layer was used, whereby image formation was carried out with the application of a voltage of 4.5 kV to the photoconductor, which was lower than in the case where a Se photoconductor was used with the application of a voltage of 5 kV thereto.

The surface potential of the photoconductor prior to the exposure to light was uniform and 400 V in a solid image area. The image density and color tone obtained by the latent electrostatic image formation by the photoconductor being exposed to a light image, and the development thereof, were excellent, and the image quality obtained did not change even when this image formation process was repeated, and the performance of the photoconductor did not change, either.

EXAMPLE 8

In an analog type image formation apparatus, using a light source emitting white light, as shown in FIG. 4, which was used in Example 3, carbon dioxide was used as the charging atmosphere gas, and a toner for use in a low potential development was used, and also a photoconductor comprising a 30 $\mu$m thick $Se_2As_2$ photoconductive layer was used, whereby image formation was carried out with the application of a voltage of 4.5 kV to the photoconductor, which was lower than in the case where a photoconductor comprising a 60 $\mu$m thick Se photoconductive layer was used with the application of a voltage of 5 kV thereto.

The surface potential of the photoconductor prior to the exposure to light was uniform and 400 V in a solid image area. The image density and color tone obtained by the latent electrostatic image formation by the photoconductor being exposed to a light image, and the development thereof, were excellent, and the image quality obtained did not change even when this image formation process was repeated, and the performance of the photoconductor did not change, either.

EXAMPLE 9

In a digital type image formation apparatus, using a light source emitting blue light, as shown in FIG. 4, which was used in Example 3, carbon dioxide was used as the charging atmosphere gas, and a toner for use in a low potential development was used, and also a photoconductor comprising a 20 $\mu$m thick amorphous silicon photoconduc- tive layer was used, whereby image formation was carried out with the application of a voltage of 4.5 kV to the photoconductor, which was lower than in the case where a Se photoconductor was used with the application of a voltage of 5 kV thereto.

The surface potential of the photoconductor prior to the exposure to light was uniform and 400 V in a solid image area. The image density and color tone obtained by the latent electrostatic image formation by the photoconductor being exposed to a light image, and the development thereof, were excellent, and the image quality obtained did not change even when this image formation process was repeated, and the performance of the photoconductor did not change, either.

Comparative Example 1

In an analog type image formation apparatus, using a light source emitting white light, as shown in FIG. 4, which was used in Example 3, argon was used as the charging atmosphere gas, and a toner for use in a low potential development was used, and also a photoconductor comprising a 20 μm thick amorphous silicon photoconductive layer was used, whereby image formation was carried out with the application of a voltage of 4.5 kV to the photoconductor, which was lower than in the case where a Se photoconductor was used with the application of a voltage of 5 kV thereto.

The surface potential of the photoconductor prior to the exposure to light was not uniform, in a range of 380 V to 400 V in a solid image area. The image density and color tone obtained by the latent electrostatic image formation by the photoconductor being exposed to a light image, and the development thereof, were no good, since the image density was not uniform, and with respect to the color tone, the color of cyan was found to be slightly intensified.

Comparative Example 2

In a digital type image formation apparatus, using a blue diode emitting blue light, as shown in FIG. 4, which was used in Example 3, argon was used as the charging atmosphere gas, and a toner for use in a low potential development was used, and also a photoconductor comprising a 20 μm thick amorphous silicon photoconductive layer was used, whereby image formation was carried out with the application of a voltage of 4.5 kV to the photoconductor, which was lower than in the case where a Se photoconductor was used with the application of a voltage of 5 kV thereto.

The surface potential of the photoconductor prior to the exposure to light was not uniform, in a range of 370 V to 390 V in a solid image area. The image density obtained by the latent electrostatic image formation by the photoconductor being exposed to a light image, and the development thereof, was not uniform.

In order to obtain the same corona charge current in the atmosphere of carbon dioxide as in the atmosphere of air, it is necessary to increase the applied voltage. However, when the low potential development toner is employed as in the above-mentioned Examples 7, 8 and 9, excellent image quality can be obtained under the application of the applied voltage at the conventional level. Furthermore, when high voltage is applied to a photoconductor having low durability to the application of voltage, the photoconductor may be subjected to dielectric breakdown. However, according to the present invention, the charging is carried out with the application of low voltage, the voltage durability of the photoconductor does not become a problem.

Figure 14:
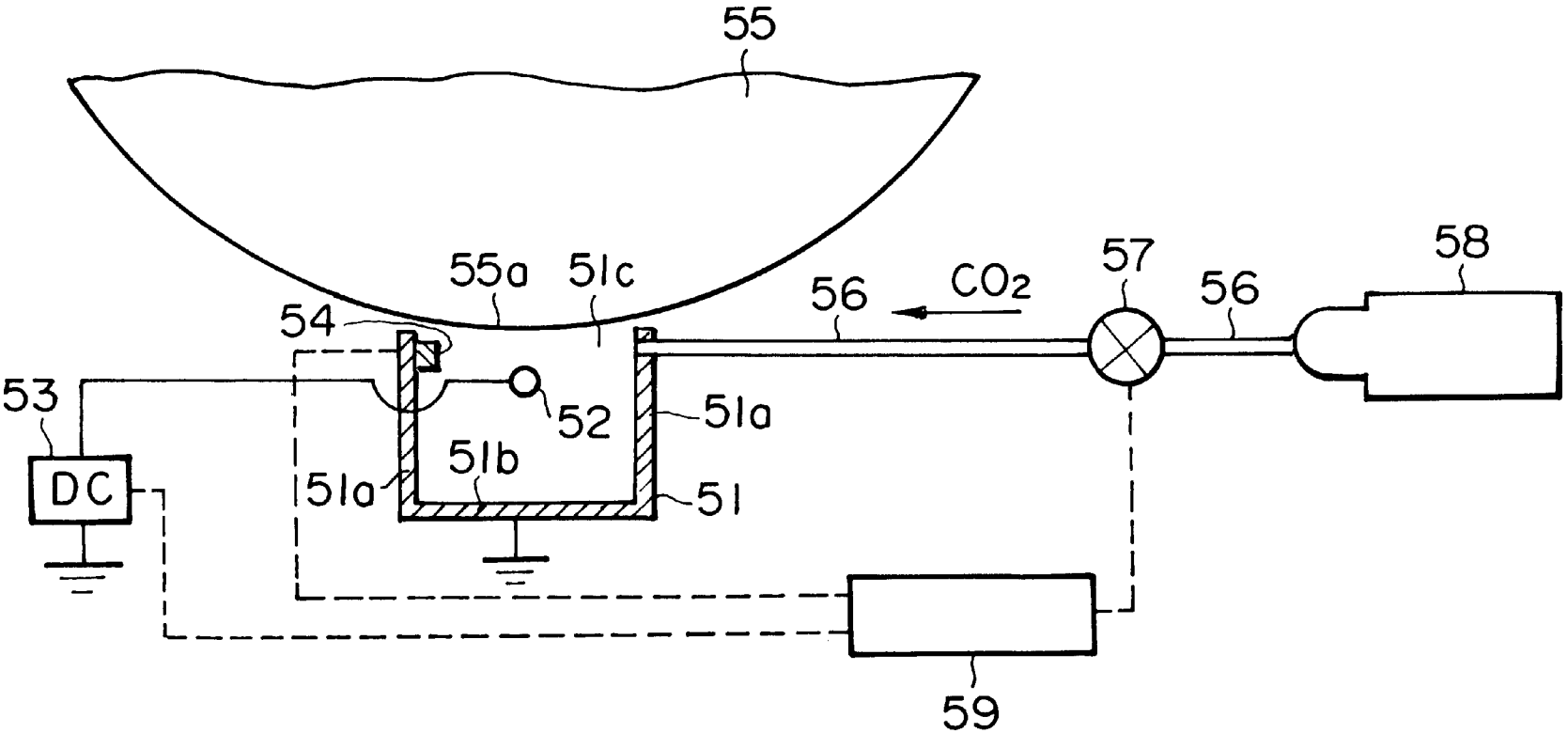
FIG. 14 is a schematic cross-sectional view of a main portion of an image formation apparatus provided with the corona charger of the present invention.
Figure 15:
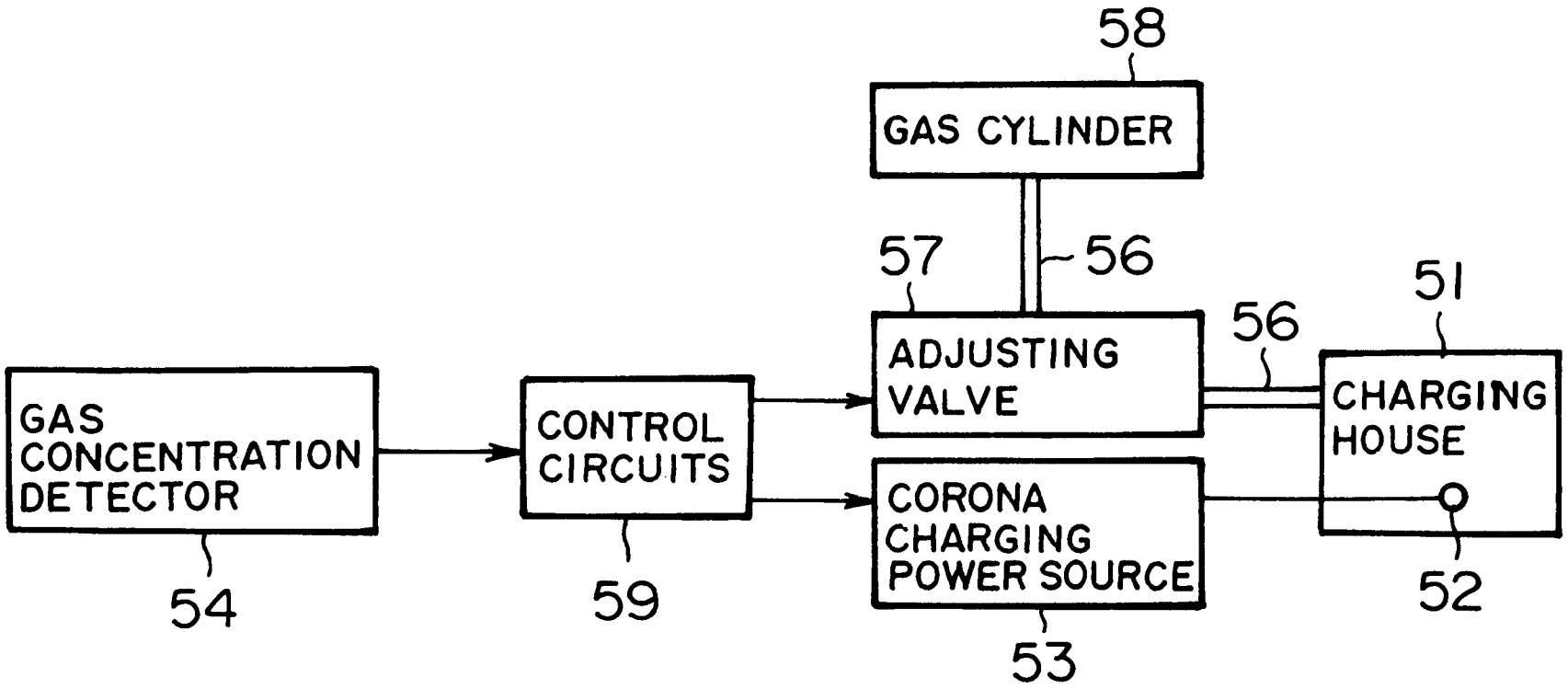
FIG. 15 is a block diagram in explanation of the supply of a non-ozone-generating gas to a charging house for use in the image formation apparatus shown in FIG. 14.

FIG. 14 is a schematic cross-sectional view of a main portion of an image formation apparatus provided with the corona charger of the present invention.

In FIG. 14, reference numeral 51 indicates a case-shaped charging house with an upper opening 51*c*, which serves as a container as well as an electrode. A side wall 51*a* and a bottom plate 51*b* of the charging house 51 are tightly sealed. In a central portion of the charging house 51, there is provided a charging wire 52 in the shape of a stylus which serves as a counter electrode. To this charging wire 52 is connected a corona charging power source (DC) 53. On the side wall 51*a* of the charging house 51, there is provided a gas concentration detector 54 for detecting the concentration of the gas within the charging house 51.

The gas concentration detector 54 may be a gas detector for detecting whether or not the concentration of a non-ozone-generating gas supplied to the charging house 51 is appropriately maintained, or a gas detector for directly detecting the concentration of a gas which has adverse effects on the environment or causes the pollution of the environment, such as ozone which is generated when air is mixed with the non-ozone-generating gas, and gases of nitrogen oxides ($NO_x$). Alternatively, the gas concentration detector 54 may be a gas detector for detecting the concentration of the air which enters the charging house 51.

Above the opening 51*c* of the charging house 51 is situated a lower portion of the outer peripheral surface 55*a* of a drum-shaped photoconductor 55, which is hereinafter referred to as the photoconductor drum 55. A rotating shaft for the photoconductor drum 55 is situated in parallel to the longitudinal direction of the charging house 51. As the photoconductor for use in the photoconductor drum 55, conventional photoconductors such as Se photoconductor and SeAs photoconductor can be employed.

Furthermore, according to the present invention, since the generation of ozone and $NO_x$ can be significantly hindered, photoconductors which may be considered vulnerable to such gases can also be employed.

One side wall 51*a* of the charging house 51 is connected to a gas supply pipe 56 serving as gas supply means. Through the gas supply pipe 56, the non-ozone-generating gas is supplied to the charging house 51 so that the charging house 51 is filled with the non-ozone-generating gas. To the gas supply pipe 56 is connected a gas supply source for supplying the non-ozone-generating gas, for example, a gas cylinder 58 filled with carbon dioxide.

An adjusting valve 57 serving as gas supply adjusting means is disposed midway in the gas supply pipe 56. The adjusting valve 57 is electrically connected to control circuits 59. The control circuits 59 are electrically connected to a gas concentration detector 54 and also to the corona charging power source 53. The control circuits 59 are under control in response to a signal corresponding to the concentration of the charging atmosphere gas, which signal is output from the gas concentration detector 54. In accordance with a signal from the control circuits 59, the adjusting valve 57 is opened or closed, so that the non-ozone-generating gas is intermittently supplied to the charging house 51, and the corona charging power source 53 is put in operation and a corona charging voltage is applied.

In Step 3, a signal indicating the gas concentration N output from the gas concentration detector 54 is evaluated by the control circuits 56, and in accordance with the evaluation of the signal, the adjusting valve 57 and the corona charging power source 53 are controlled. When the gas concentration N does not reach a predetermined concentration range $N_0$, the adjusting valve 57 is opened in accordance with the loop of S2, S3 and S4, without the corona charging power source 53 being turned ON, so that the non-ozone-generating gas is gradually supplied to the charging house 51 from the gas cylinder 58, and the gas remaining in the charging house 51 is discharged from the opening 51 and replaced by the non-ozone-generating gas.

In Step S3, when it is confirmed after an extended operation that the gas concentration N reaches the predetermined concentration No, this step proceeds to Step S5 and the adjusting valve 57 is closed and the supply of the non-ozone-generating gas is stopped. Subsequently in accordance with a signal output from the control circuits 59, the corona charging current 53 is turned ON in Step S6, so that a DC voltage is applied across the charging house 51 and the charging wire 52, whereby corona charging is initiated and corona ions are generated.

A charging application voltage is turned ON by a grid power source (not shown), a DC voltage is applied across the charging house 51 and the photoconductor drum 55, so that corona charging is initiated between the charging house 51 and the photoconductor drum 55. Corona ions generated by this charger are discharged from the upper opening 51*c*, so that the outer surface 55*a* of the photoconductor drum 55 is uniformly charged.

Figure 16:
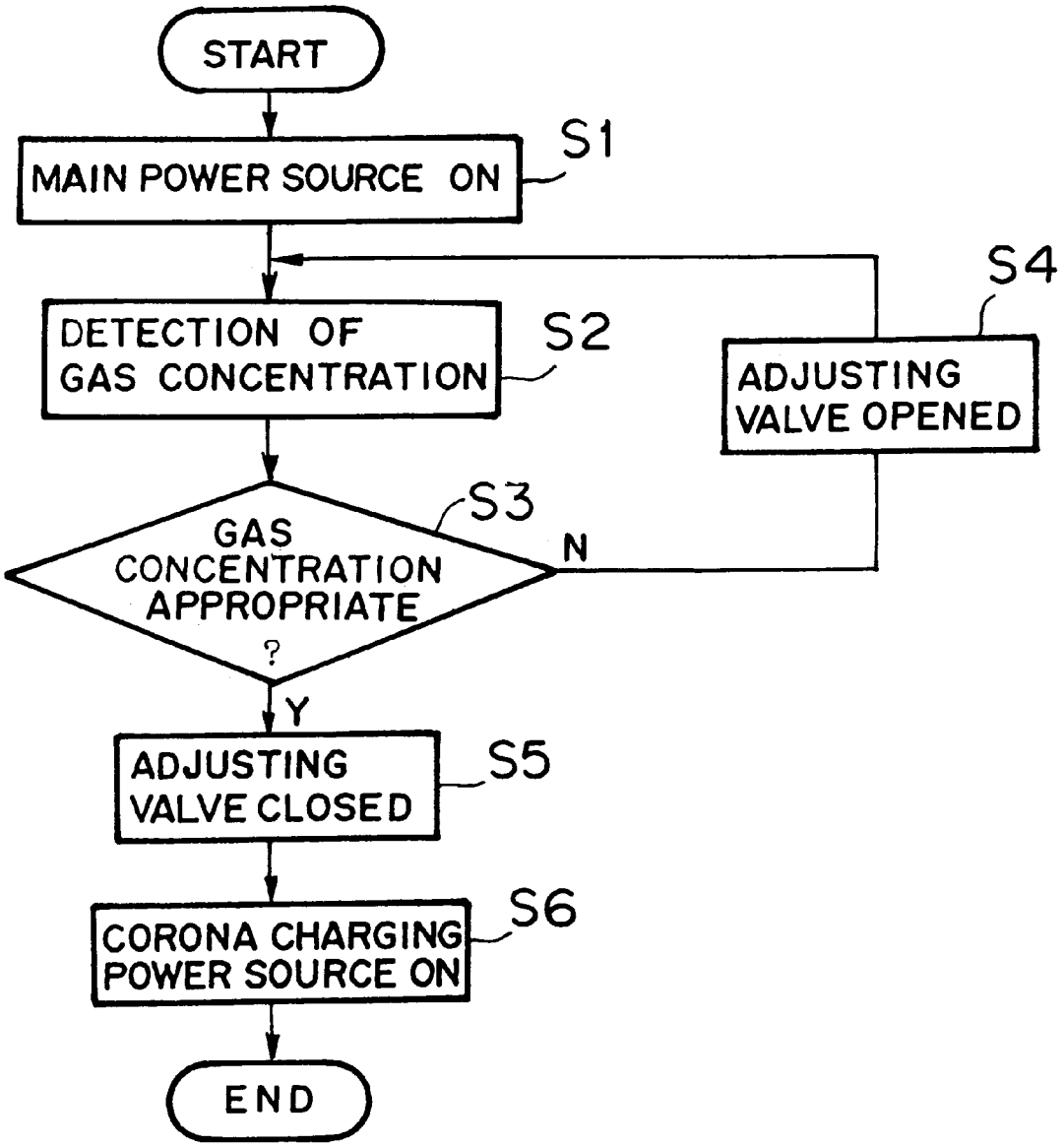
FIG. 16 is a flow chart in explanation of the control of the supply of the non-ozone-generating gas to the charging house for use in the image formation apparatus shown in FIG. 14.
Figure 17:
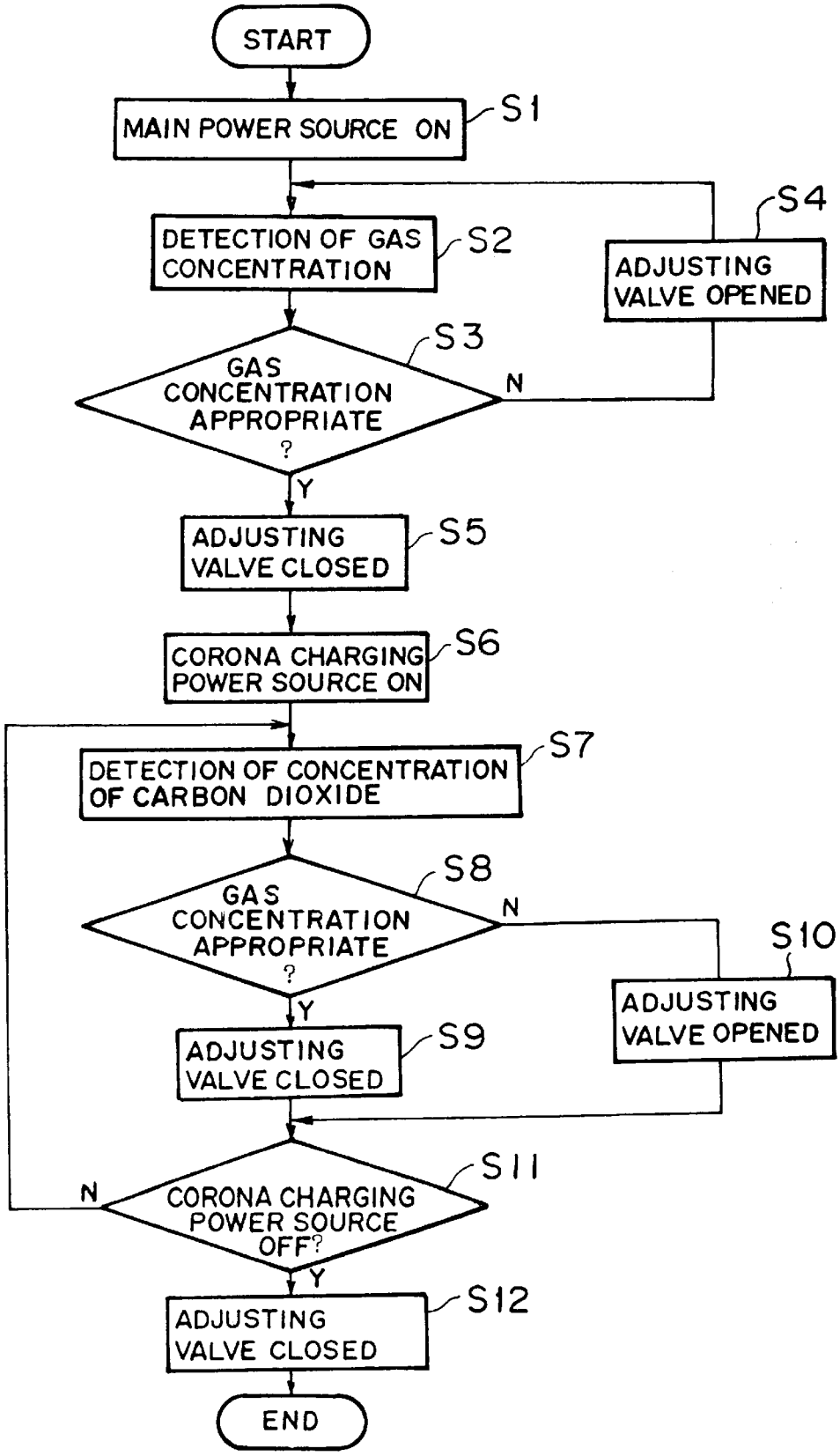
FIG. 17 is another flow chart in explanation of the control of the supply of the non-ozone-generating gas to the charging house for use in the image formation apparatus shown in FIG. 14.

The above corona charging is conducted in the atmosphere of the non-ozone-generating gas in the charging house 51, so that ozone is not substantially generated. However, since the upper opening 51*c* of the charging house 51 is opened, the non-ozone-generating gas gradually diffuses from the charging house 51 and instead air enters. In this case, as shown in FIG. 17, Steps S7 to S12 may be added to the flow shown in FIG. 16.

In Step S8, when it is detected that the concentration of the non-ozone-generating gas in the charging house 51 is decreased and is below the predetermined concentration $N_0$, the adjusting valve 57 is opened again in Step S10. When the adjusting valve 57 is opened, the non-ozone-generating gas is again supplied to the charging house 51 from the gas cylinder 58. As long as the gas concentration does not reach the predetermined concentration $N_0$, the adjusting valve 57 is kept opened and the non-ozone-generating gas is continuously supplied to the charging house 51 as it is being checked whether the corona charging power source 53 is ON or not.

In Step S8, the gas concentration reaches the predetermined concentration $N_0$, this step proceeds to Step S9 where the adjusting valve 57 is closed, and the charging operation is continuously conducted without the non-ozone-generating gas being supplied in accordance with the loop of Steps S11, S7, S8 and S9.

In Step S11, when the corona charging power source is OFF, this step proceeds to Step S12, and the adjusting valve 57 is closed and the operation of the charger is terminated.

In FIG. 17, Steps S2, S3, S4 and S5 may be omitted. In this case, upon the main power source being turned ON, the corona charging is initiated. At this moment, if the concentration of the non-ozone-generating gas in the charging house 51 is as low as that in air, ozone will be generated. However, the amount of ozone thus generated is extremely small. Subsequently the adjusting valve 57 is immediately opened in accordance with the loop of Steps S7, S8, S10 ad S11, so that the air in the charging house 51 is replaced by the non-ozone-generating gas supplied thereto.

Thereafter, the uniformly charged photoconductor drum 55 is exposed to a light image and a latent electrostatic image corresponding to the light image is formed on the photoconductor drum 55. The latent electrostatic image is then developed with toner to a visible toner image. The thus developed toner image is then transferred to an image transfer sheet such as a sheet of paper, and fixed thereto. Thus, high quality images are formed on the image transfer sheet.

In the above-mentioned charger, the gas in the charging house 51 is directly detected and the concentration thereof can be maintained within a predetermined range, whereby the charging current by corona charging can be maintained in a stable manner, while minimizing the generation of ozone, even if the corona charging is continued for an extended period of time.

For instance, in the image formation apparatus as shown in FIG. 1, the above-mentioned charger can be employed as the charger 2 for uniformly charging the surface of the photoconductor drum 1, a charger for use in the image transfer unit 5 for applying charges with a polarity opposite to the polarity of a toner which forms a toner image to the back side of the image transfer sheet in order to transfer the toner image to the image transfer sheet, a charger for use in the charge quenching unit 7 for quenching unnecessary charges remaining on the surface of the photoconductor drum 1 after the transfer of the toner image, or a charge quenching device for applying corona charges to the back side of the image transfer sheet to quench the charges remaining on the image transfer sheet and reduce the attraction of the image transfer sheet to the photoconductor drum 1.

EXAMPLE 10

Figure 18:
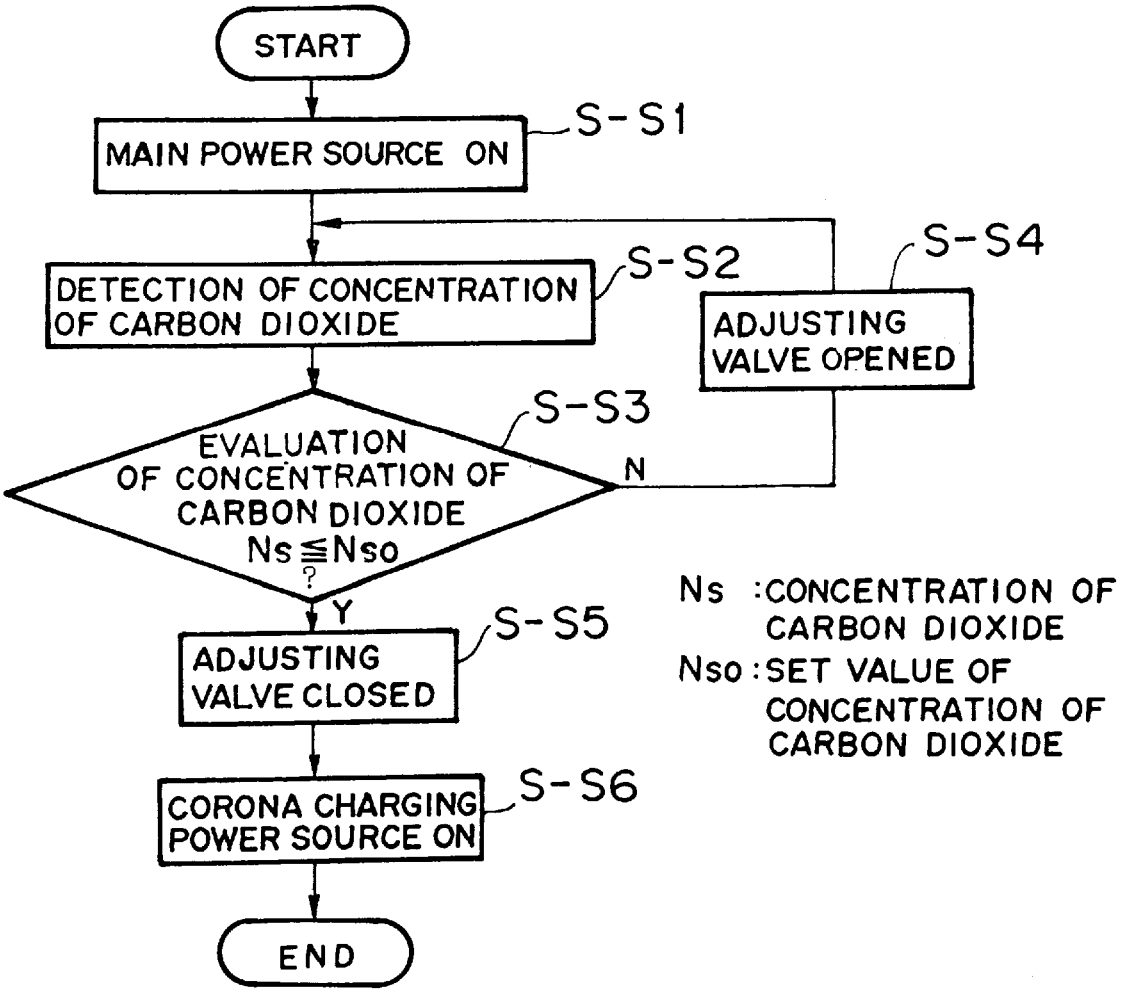
FIG. 18 is a flow chart in explanation of the control of the supply of the non-ozone-generating gas to the charging house in Example 10.

As shown in FIG. 18, in this Example, a carbon dioxide concentration detector for detecting the concentration of carbon dioxide supplied is employed as the gas concentration detector 54. In this case, the set value $N_{s0}$ of carbon dioxide concentration is set at 99 volume %. Whether or not the concentration is decreased to less than 99 volume % is detected by the control circuits 59.

When the main power source is turned ON, the carbon dioxide concentration Ns is detected in Step S-S2, and the carbon dioxide concentration Ns is evaluated in Step S-S3. When it is detected that the carbon dioxide concentration Ns in the charging house 51 is greater than the set value $N_{s0}$, which is appropriate, this step proceeds to Step S-S6 where corona charging power source is turned ON and corona charging is initiated.

When it is detected that the carbon dioxide concentration Ns in the charging house 51 is below the set value $N_{s0}$, which is not appropriate, this step proceeds to Step S-S4 or S-S10 (refer to FIG. 19), and the adjusting valve 57 is opened, and carbon dioxide is supplied to the charging house 51 from the gas cylinder 58. As the concentration of carbon dioxide in the charging house 51 is increased, the generation of ozone by corona charging is hindered.

Figure 19:
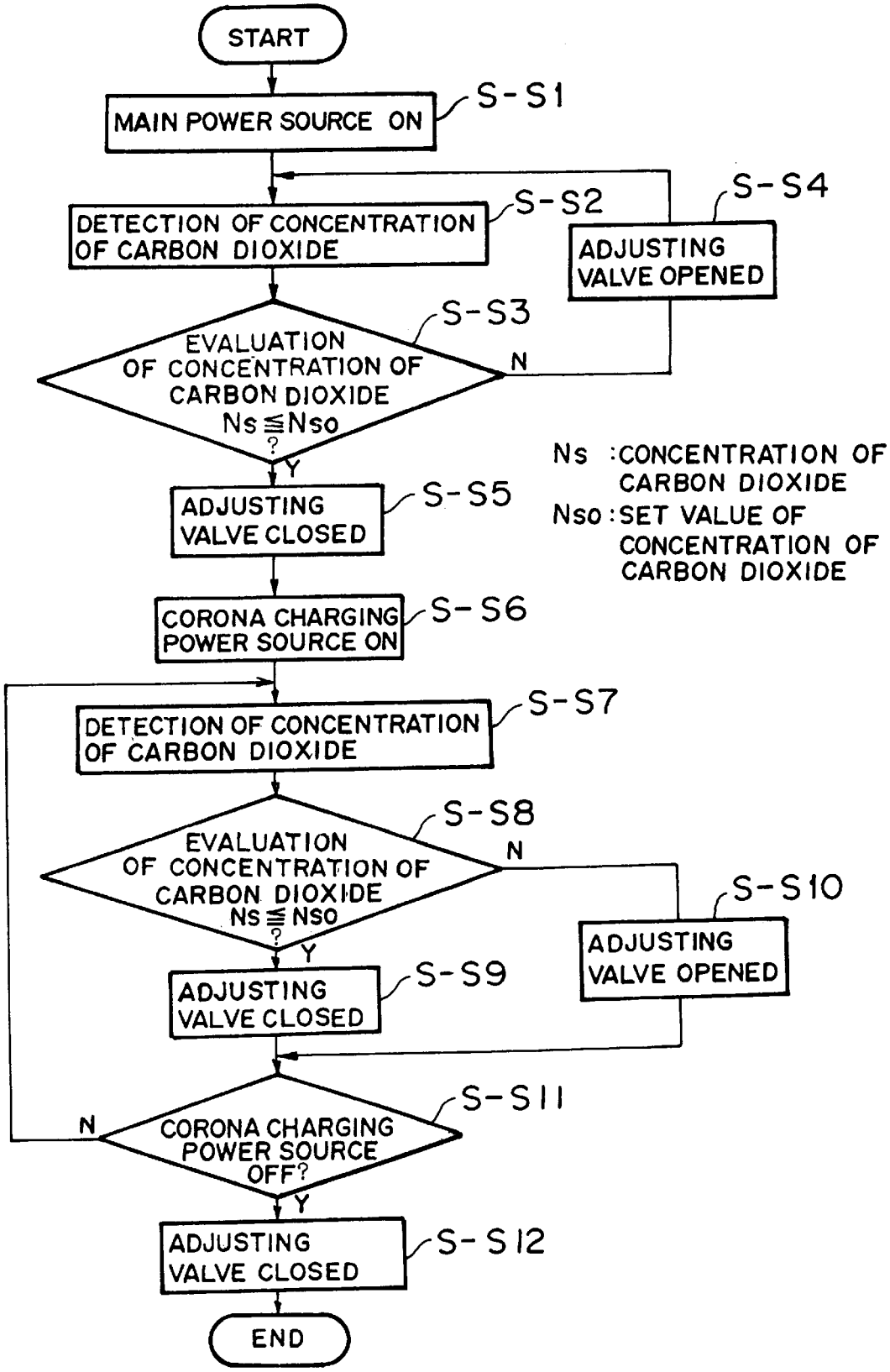
FIG. 19 is another flow chart in explanation of the control of the supply of the non-ozone-generating gas to the charging house in Example 10.
Figure 20:
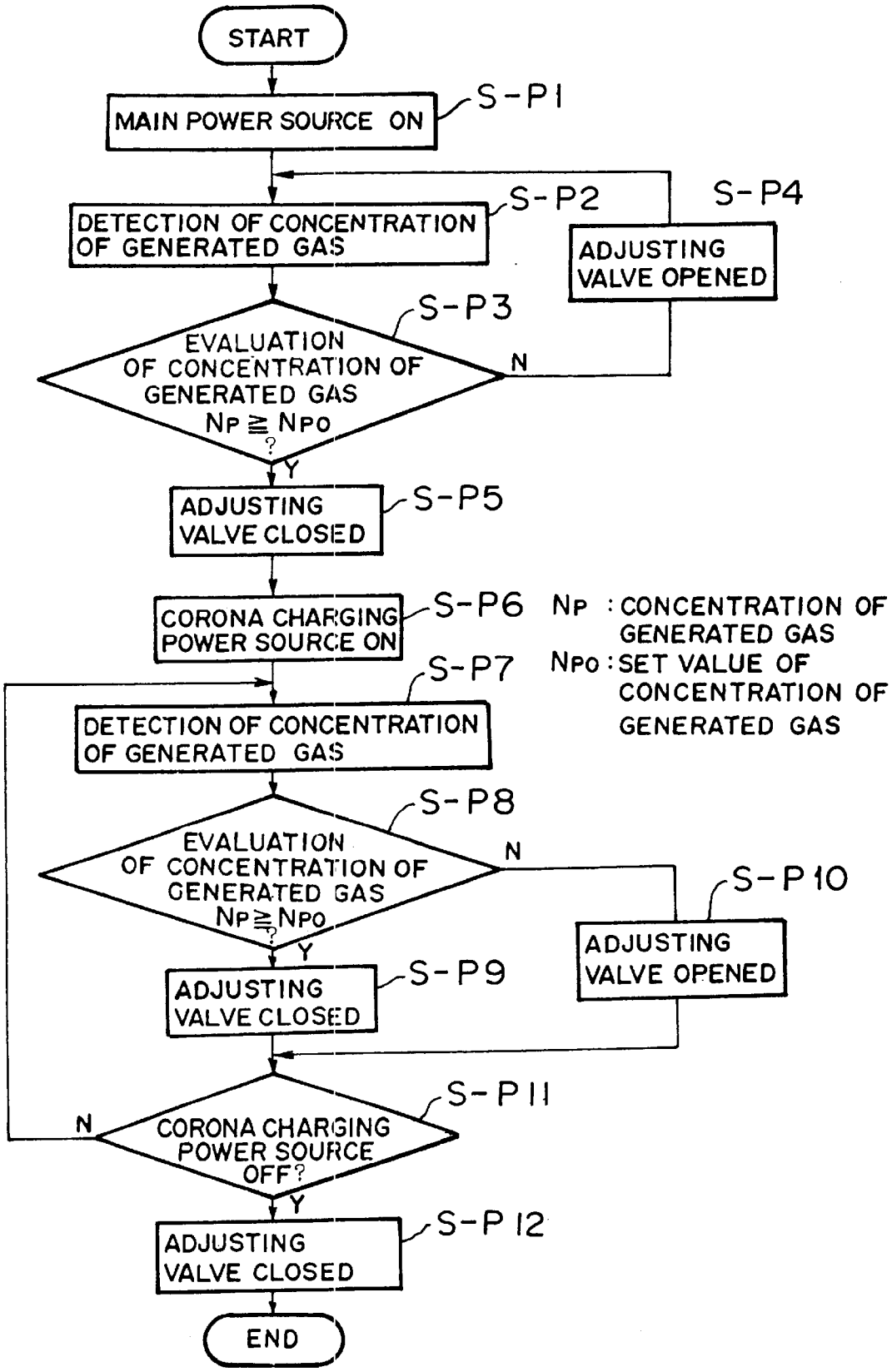
FIG. 20 is a flow chart in explanation of the control of the supply of the non-ozone-generating gas to the charging house in Examples 11 and 12.

The gas supply can be controlled in a flow chart as shown in FIG. 19. In this case, the supply of carbon dioxide after the initiation of corona charging is controlled in accordance with the loop of Steps S-S7 to S-S11.

Even after the corona charging power source 53 is turned ON, the concentration Ns of carbon dioxide is detected in Step S-S7, and the detected concentration Ns is evaluated in Step S-S8. In the case where the concentration Ns of carbon dioxide within the charging house 51 is greater than the set value $N_{s0}$, which is appropriate, this step proceeds to Step S-S9, corona charging is continued without the supply of carbon dioxide in accordance with the loop of Steps S-S11, S-S7, S-S8 and S-S9.

In the case where it is detected that the concentration Ns of carbon dioxide within the charging house 51 is below the set value $N_{s0}$, with the diffusion of carbon dioxide in the course of an extended operation, which is not appropriate, carbon dioxide is supplied to the charging house 51 from the gas cylinder 58 in accordance with the loop of Steps S-S11, S-S7, S-S8 and S-S10.

When the concentration of carbon dioxide in the charging house 51 is sufficiently increased, Step S-S8 proceeds to Step S-S9 where the adjusting valve 57 is closed.

In Step S-S11, when the corona charging power source 53 is OFF, Step S-S11 proceeds to Step S-S12 where the adjusting valve 57 is closed, and the operation of the charger is terminated.

In the thus constructed charger, the carbon dioxide in the charging house 51 is directly detected and the concentration thereof is maintained in a constant range. For example, when the main power source is turned ON, the corona charging power source 53 is subsequently turned ON, so that corona charging is initiated between the charging house 51 and the charging wire 52. The corona charging voltage at this moment is set at −5.8 KV, and the charging current is at about −23 μA in a stable manner, whereby the concentration of ozone during the corona charging is constantly maintained at not more than 0.05 ppm.

When the above-mentioned corona charger is used as the charger for charging the surface of a photoconductor, uniform charging can be conducted for an extended period of time, yielding high quality copy images.

For comparison, the above corona charging was conduced in the atmosphere of air, without supplying carbon dioxide. The result was that the concentration of ozone increased up to 2 ppm with time.

EXAMPLE 11

In this Example, the carbon dioxide concentration detector 54 employed in Example 10 was replaced with an ozone concentration detector 54, which detects the concentration of generated ozone.

The ozone concentration detector 54 outputs a detection signal to the control circuits 59 when ozone with a concentration of about 0.001 ppm is detected.

The concentration of ozone is detected in Step S-P2 (or S-P7), and the concentration of the generated ozone gas, Np, is evaluated.

The main power source is turned ON, the ozone concentration detector 54 is operated in Step S-P2. When no ozone is detected, it is regarded that the concentration of ozone is not more than about 0.001 ppm.

When the ozone concentration Np in the charging house 51 is determined to be less than a set value $Np_0$, the corona charging power source is turned ON in Step S-P6, so that corona charging is initiated.

When ozone is detected (that is, the detected ozone concentration Np exceeds the set value $Np_0$), the adjusting valve 57 is opened in accordance with the loop of S-P2, S-P3, S-P4 (or S-P7, S-P8, S-P10 and S-P11), and carbon dioxide is supplied to the charging house 51 from the gas cylinder 58. When the concentration of carbon dioxide within the charging house 51 is increased, the generation of ozone by corona charging is hindered, and this step proceeds to Step S-P5 (or S-P9) where the adjusting valve 57 is closed.

In Example 11, even when corona charging is conducted for an extended period of time, the concentration of generated ozone is not increased. Furthermore, the charging current by the corona charging can be maintained at about −23 μA in a stable manner, so that when this charger is used as the charger for the photoconductor drum 55 for the image formation apparatus, high quality image formation can be carried out since the charger is capable of performing uniform charging for an extended period of time.

Furthermore, in Example 11, ozone, which is a hazardous gas having adverse effects on the environment, can be directly detected, and when the ozone is detected, carbon dioxide, which serves as a gas which hinders the generation of ozone, can be supplied, so that the charger can be operated securely in the atmosphere in which the generation of ozone is hindered.

The structure and effects and advantages of the charger in this example are the same as those of the charger in Example 10.

EXAMPLE 12

When corona charging is conducted in the air, oxygen reacts with nitrogen in the air, so that nitrogen oxides (NOx) are produced. In this Example, a NOx gas concentration detector is used instead of the ozone concentration detector 54 employed in Example 11, in order to check whether or not the charging atmosphere gas in the charging house 51 is contaminated with air.

In this case, the NOx gas concentration is set at 0.001 ppm as the set value of the generated gas concentration. The NOx gas concentration is detected in Step S-P2 (or Step S-P7), and the detected NOx gas concentration (the generated gas concentration Np) is evaluated in Step S-P3 (or Step S-P8).

When the main power source is turned ON, the gas concentration detector is operated to detect the concentration of the generated gas in Step S-P2, and the detected gas concentration is evaluated in S-P3. When the NOx gas concentration in the charging gas house 51 is evaluated as being below the set value Npo, the corona charging power source is turned ON, whereby corona charging is initiated. When the NOx gas concentration in the charging gas house 51 is evaluated as exceeding the set value $Np_0$, the adjusting valve 57 is opened in accordance with the loop of Steps S-P2, S-P3, S-P4 or the loop of Steps S-P7, S-P8, S-P10 and S-P11 and carbon dioxide is supplied to the charging gas house 51 from the gas cylinder 58.

When the concentration of carbon dioxide within the charging house 51 is increased, the generation of ozone by corona charging is hindered, and even when corona charging is conducted for an extended period of time, the concentration of generated ozone is not increased. Furthermore, the charging current by the corona charging can be maintained at about −23 μA in a stable manner.

In Example 12, the concentration of air which enters the charging house 51 is detected by detecting the concentration of the NOx gas which is generated by the corona charging, and when the NOx gas is detected, carbon dioxide serving as the non-ozone-generating gas is supplied to the charging house 51 in accordance with the concentration of the detected NOx gas, so that the charger can be operated under the conditions that the generation of ozone is hindered.

The structure and effects and advantages of the charger in this example are the same as those of the charger in Examples 10 and 11.

EXAMPLE 13

Figure 21:
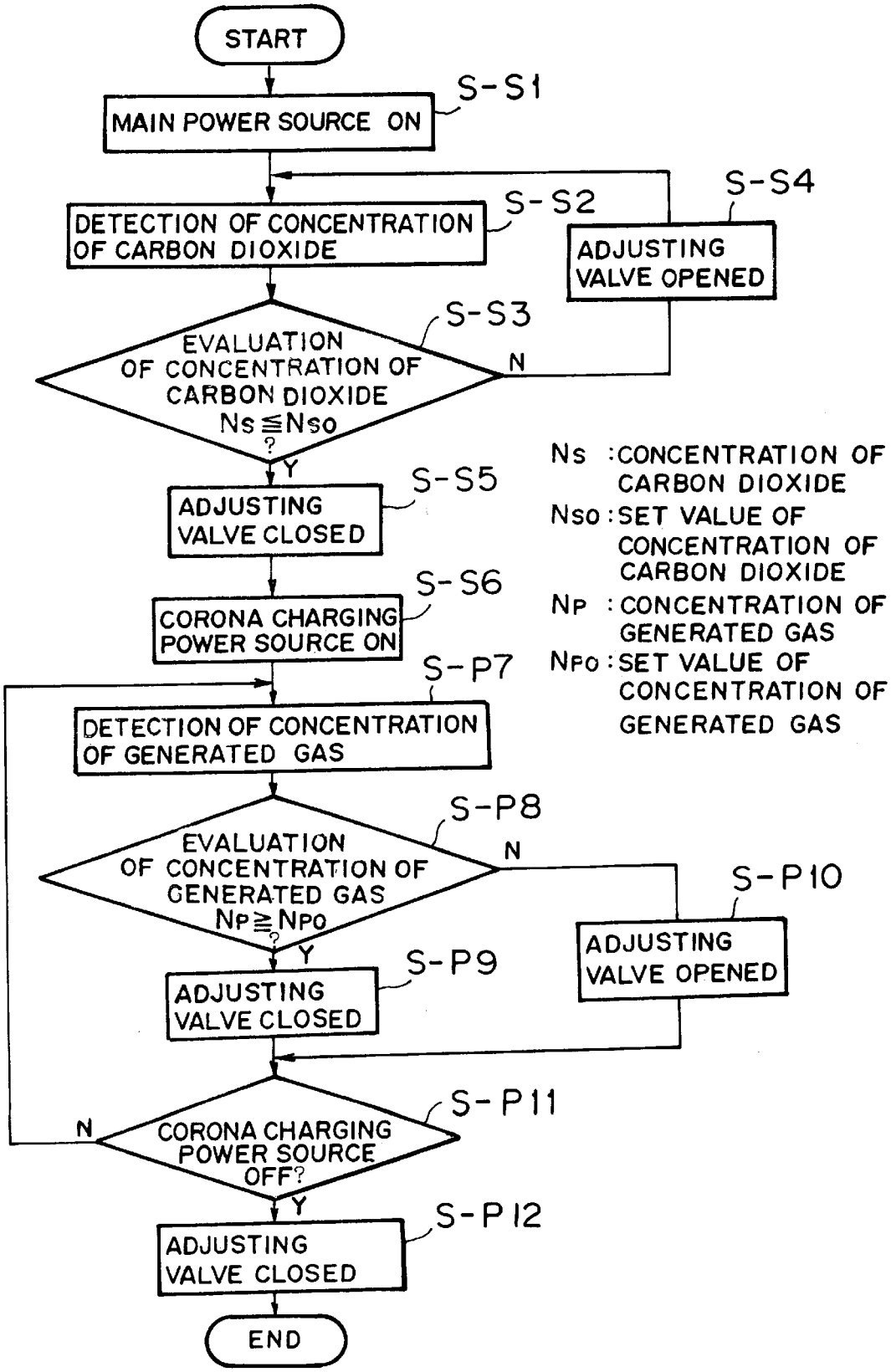
FIG. 21 is a flow chart in explanation of the control of the supply of the non-ozone-generating gas to the charging house in Example 13.

The gas concentration detection means employed in Example 10 can be modified so as to serve as both a carbon dioxide concentration detector and a generated gas concentration detector as shown in FIG. 21. In this case, the controls in Step S-S1 to Step S-S6 are the same as in Example 10, and the controls in Step S-P7 to Step S-P12 are the same as in Example 11.

When the main power source is turned ON, the carbon dioxide concentration detector is operated, so that the carbon dioxide concentration Ns is evaluated in Step S-S3. When the carbon dioxide concentration Ns is detected to be larger than the set value $Ns_0$ thereof, the corona charging power source is turned ON in Step S-S6, so that corona charging is initiated.

The ozone concentration Np is detected in Step S-P7, and the generated gas concentration Np is evaluated. When the ozone concentration Np exceeds the set value thereof, the adjusting valve 57 is opened in accordance with the loop of Steps S-P7, S-P8, S-P10 and S-P11, so that carbon dioxide is again supplied to the charging house 51 from the gas cylinder 58. When the concentration of carbon dioxide in the charging house 51 is increased, the generation of ozone by corona charging is hindered.

In Example 13, after the main power source is turned ON, the air in the charging house 51 is sufficiently replaced by carbon dioxide, corona charging is initiated. During the operation of the charger for an extended period of time, the supply of carbon dioxide is controlled in response to the generated ozone concentration Np. Therefore, the generation of ozone is hindered at the initial stage of the operation of the charger, and even when the charger is operated for an extended period of time, the ozone concentration Np is not increased.

The structure and effects and advantages of the charger in this example are the same as those of the charger in Examples 10 to 12.

Figure 22:
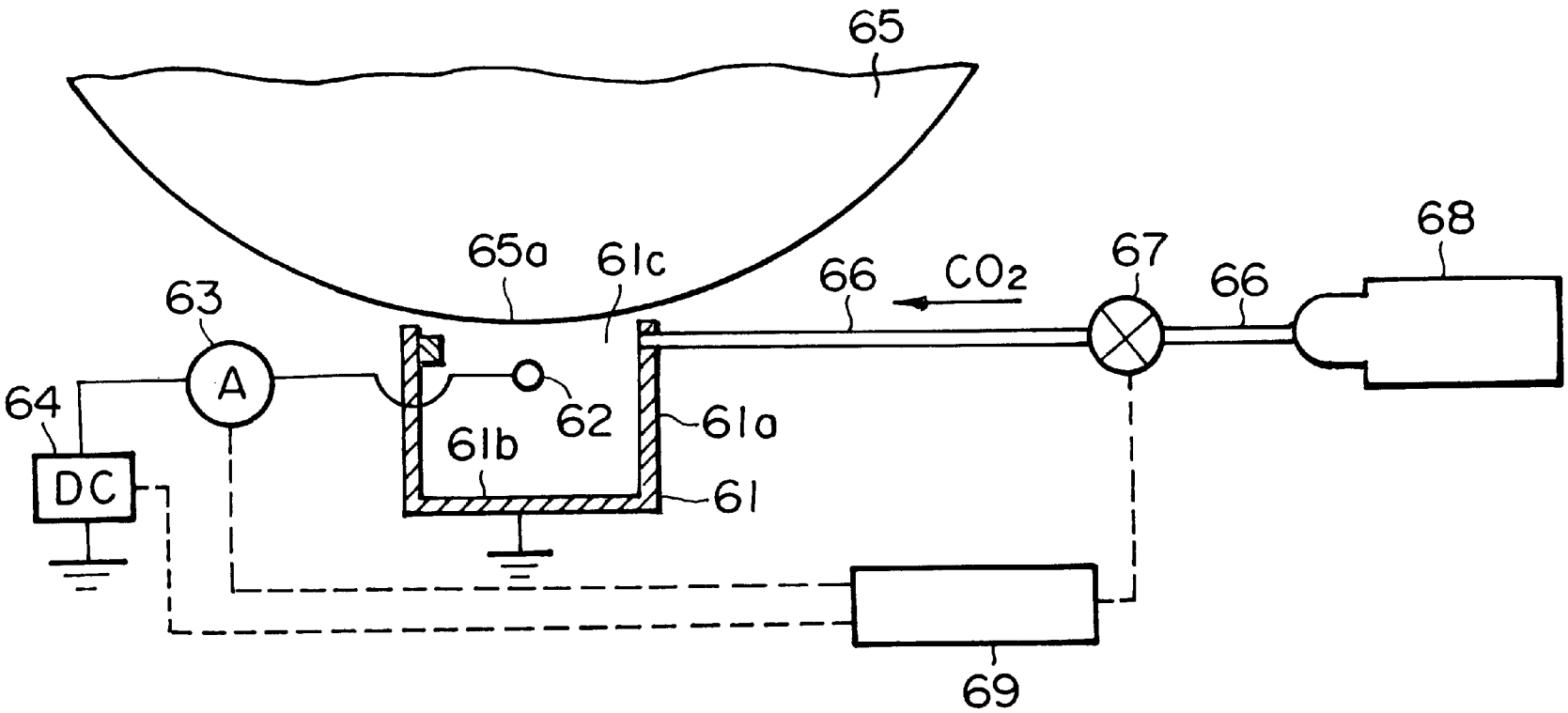
FIG. 22 is a schematic cross-sectional view of a main portion of an image formation apparatus provided with a corona charger of the present invention.

FIG. 22 is a schematic cross-sectional view of a main portion of an image formation apparatus provided with the corona charger of the present invention.

In FIG. 22, reference numeral 61 indicates a case-shaped charging house with an upper opening 61*c*, which serves as a container as well as an electrode. A side wall 61*a* and a bottom plate 61*b* of the charging house 61 are tightly sealed. In a central portion of the charging house 61, there is provided a charging wire 62 in the shape of a stylus which serves as a counter electrode. To this charging wire 62 is connected a corona charging power source (DC) 64 via an ammeter 63 for detecting the charging current.

Above the opening 61*c* of the charging house 61 is situated a lower portion of the outer peripheral surface 65*a* of a drum-shaped photoconductor 65, which is hereinafter referred to as the photoconductor drum 65. A rotating shaft for the photoconductor drum 65 is situated in parallel to the longitudinal direction of the charging house 61.

A gas supply pipe 66 serving as gas supply means is connected to one side wall 61 a of the charging house 61. The gas supply pipe 66 is connected to a gas cylinder 68 filled with carbon dioxide serving as a non-ozone-generating gas supply source, via an adjusting valve 68 serving as adjusting means for adjusting the supply of the gas.

The adjusting gas 67 is connected to control circuits 69, and the ammeter 63 and the corona charging power source 64 are connected to the control circuits 69. The control circuits 69 are operated in response to a signal which corresponds to the current density of the corona charging current from the ammeter 63. In response to the signal output from the control circuits 69, the adjusting valve 69 is opened or closed so as to supply the non-ozone-generating gas intermittently to the charging house 61.

Since carbon dioxide has a specific gravity of about 1.5 and is heavier than air, when carbon dioxide is gradually supplied to the charging house 61 from above the opening 61*c* thereof, the air in the charging house 61 is subsequently replaced by the carbon dioxide from the bottom of the charging house 61, and eventually excessive air and carbon dioxide overflow from the opening 61*c*.

Figure 23:
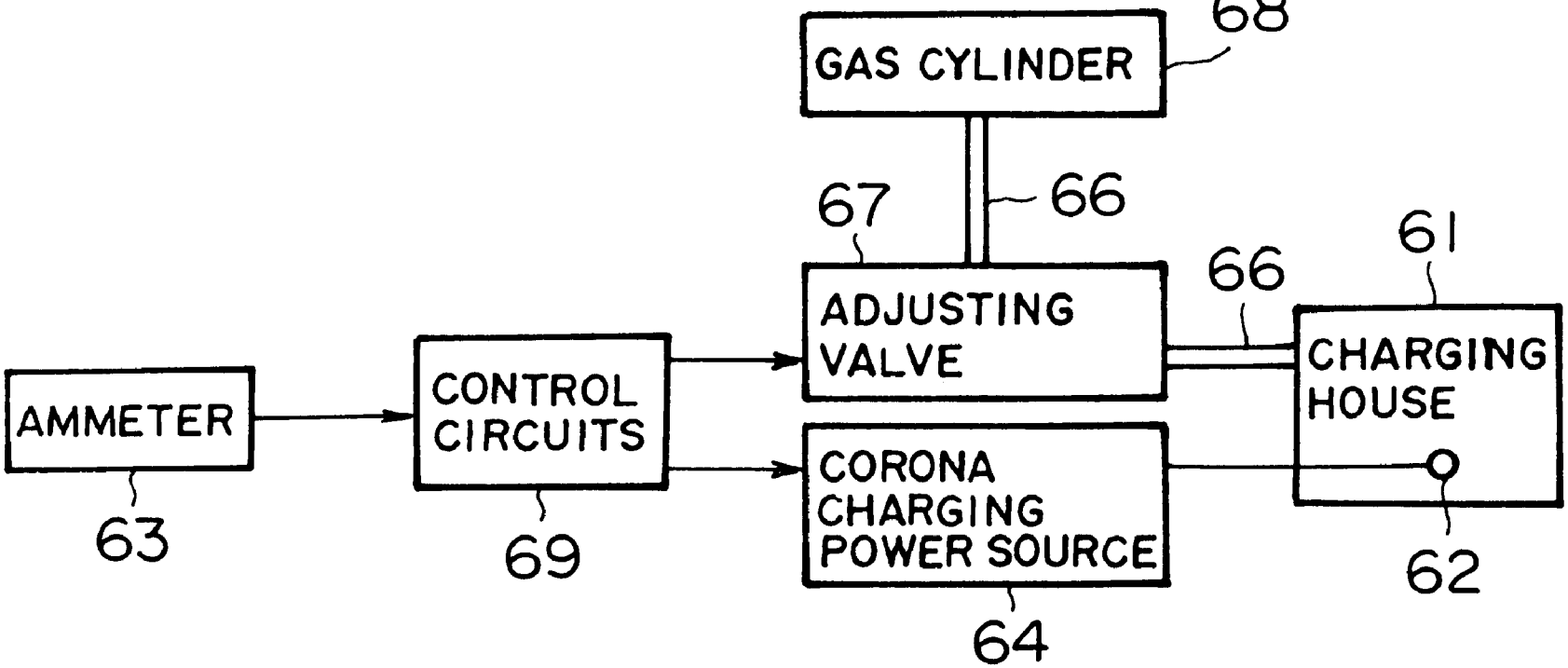
FIG. 23 is a flow chart in explanation of the control of the supply of the non-ozone-generating gas to the charging house for use in the image formation apparatus in FIG. 22.
Figure 24:
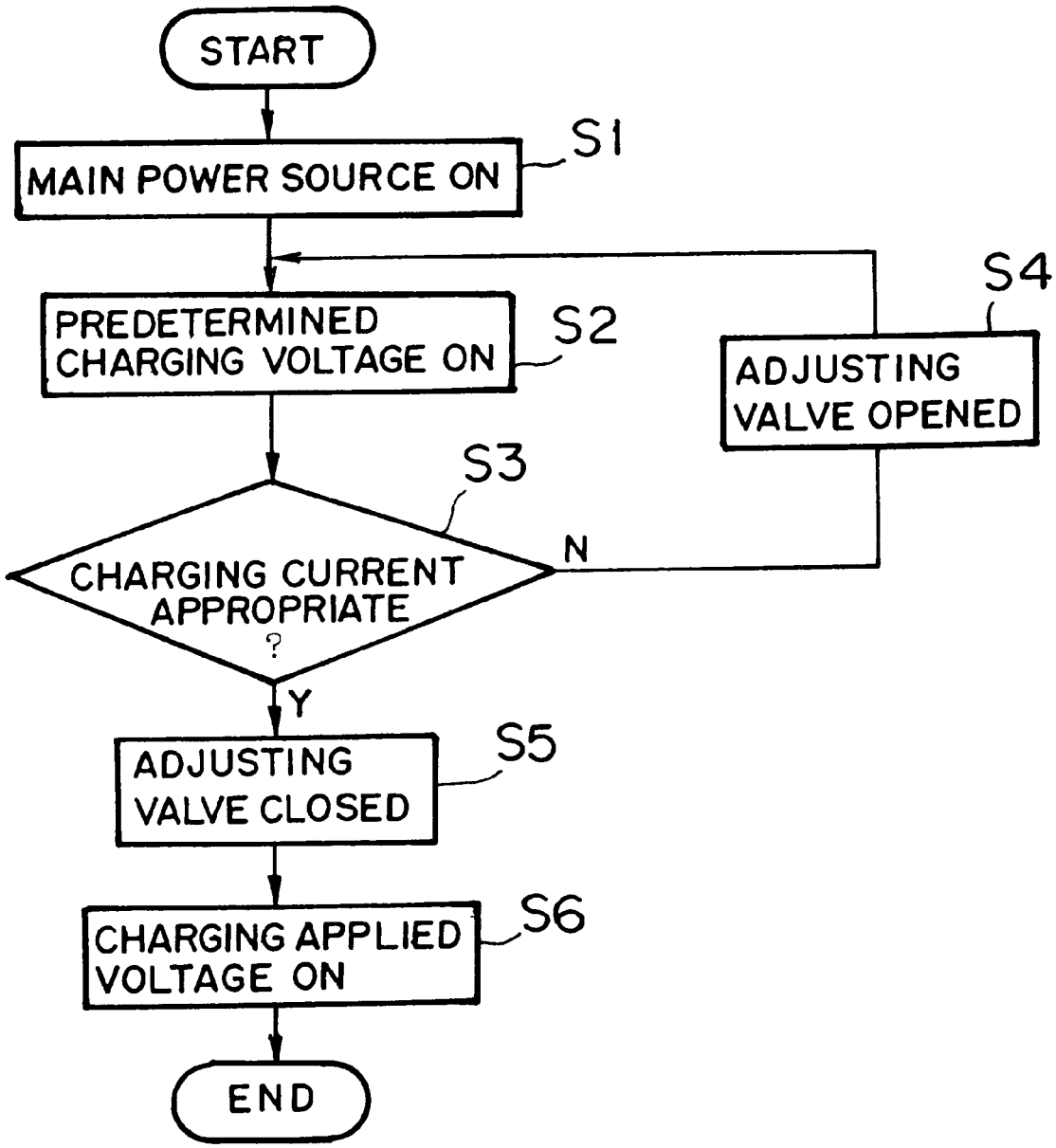
FIG. 24 is another flow chart in explanation of the control of the supply of the non-ozone-generating gas to the charging house for use in the image formation apparatus in FIG. 22.

With reference to FIG. 23 and FIG. 24, a supply system for the non-ozone-generating gas will now be explained.

With reference to a block diagram shown in FIG. 24, when the main power source is turned ON in Step S1, a predetermined charging voltage is applied between the charging house 61 and a charging wire 62 in Step S2, so that corona charging is initiated. In accordance with the initiation of the corona charging, the operation of the ammeter 63 is initiated. The ammeter 63 detects an increase or a decrease in the charging current and outputs a signal corresponding to the charging current I to control circuits 69.

In the control circuits 69, whether or not the charging current I is appropriate is evaluated based on the signal output from the ammeter 63. When the charging current I is evaluated as being not appropriate, the adjusting valve 67 is opened in Step S4 and carbon dioxide is gradually supplied to the charging house 61 from a gas cylinder 68, so that the air in the charging house 61 is substantially replaced by carbon dioxide. When the charging current I does not reach a predetermined set value, the adjusting valve 67 is kept open and carbon dioxide is continuously supplied.

When the air in the charging house 61 is replaced by carbon dioxide, the charging current I is normalized. When the charging current I is evaluated as being appropriate in Step S3, this step proceeds to Step S5 where the adjusting valve 67 is closed, and the charging application voltage is then turned ON in Step S6, whereby a D.C. voltage is applied across the charging house 61 and the photoconductor drum 65, and corona charging is initiated between the charging house 61 and the photoconductor drum 65. Corona ions generated by this charger are discharged from the upper opening 61 c, so that the outer surface 65 a of the photoconductor drum 65 is uniformly charged.

Thereafter, the uniformly charged photoconductor drum 65 is exposed to a light image and a latent electrostatic image corresponding to the light image is formed on the photoconductor drum 65. The latent electrostatic image is then developed with toner to a visible toner image. The thus developed toner image is then transferred to an image transfer sheet such as a sheet of paper, and fixed thereto. Thus, high quality images are formed on the image transfer sheet.

EXAMPLE 14

A charging potential measurement apparatus, a Paper Analyzer ("SP-428 " made by Kawaguchi Electric Works Co., Ltd.), was provided with the box-shaped charging house 61. In a side wall of the charging house 61, a gas injection hole was formed, and a gas supply pipe 66 for supplying carbon dioxide from the gas cylinder 68 is connected to the charging house 61 through the hole.

When corona charging is initiated after the air in the charging house 61 is sufficiently replaced by carbon dioxide, the corona charging current was stable at about −23 $\mu$A with an applied voltage of about −5.8 KV. This charging current was slightly higher than the corona charging current in the atmosphere of air.

When corona charging was conducted in the atmosphere of air, the pungent odor of ozone was recognized. The odor was stronger in a negative corona charging in which negative corona ions are generated than in a positive corona charging in which negative corona ions are generated.

In contrast, when corona charging was conducted in the charging house 61 to which carbon dioxide was sufficiently supplied, the odor of ozone was not substantially recognized either in the negative corona charging or in the positive corona charging.

The concentration of zone generated in the negative corona charging in the atmosphere of air was 2 ppm, while the concentration of ozone in the atmosphere of carbon dioxide was not more than 0.005 ppm in both negative corona charging and positive corona charging.

With the applied voltage in the atmosphere of carbon dioxide set at −5.8 KV, and the initial value of corona charging current set at −23 $\mu$A, the charger shown in FIG. 22 was modified in such a manner that the adjusting valve 67 is opened when a change in current density of ±5% is observed deviating from the initial value, whereby corona charging was conducted.

Since the charging house 61 is normally filled with carbon dioxide, ozone is not substantially generated. However, the charging house 61 includes an opening 61 and therefore the upper portion of the charging house 61 is open, so that the carbon dioxide in the charging house 61 gradually diffuses with time and air enters instead so as to replace the carbon dioxide and accordingly the concentration of carbon dioxide in the charging house 61 decreases with time. The corona charging current is increased due to the effects of gases such as ozone and nitrogen oxides which are slightly generated by the air which entered the charging house 61. However, when the corona current increases beyond a set value $I_0$, the adjusting valve 67 is operated by the control circuits 69, whereby carbon dioxide is supplied to the charging house 61 and replaces the air and the generated gases such as ozone and nitrogen oxides and the charging current is stabilized and stable charging can be carried out without gas sensors.

In the thus constructed charger, the charging current with time by the corona charging can be maintained within a range of −23 $\mu$A ±5% and the concentration of carbon dioxide within the charging house 61 can also be maintained substantially at 100%, whereby even when the charger is operated for an extended period of time, the concentration of ozone generated is always not more than 0.005 ppm.

EXAMPLE 15

A charging section of a commercially available copying machine (Trademark "Aficio 200" made by Ricoh EP) was modified in such a manner that carbon dioxide can be supplied as shown in FIG. 22 and that the adjusting valve 67 for the supply of carbon dioxide can be opened when there is a change of ±5% in the current, with the applied voltage being adjusted in such a manner that the initial corona charging current was made constant so as to provide high quality images.

Using the above modified copying machine, image formation was carried out repeatedly. The result was that the image quality obtained was constantly excellent.

Using the above copying machine, image formation was carried out repeatedly, with corona charging being conducted in the atmosphere of air without applying carbon dioxide. The result was that the charging current increased as the image formation was repeated. When the increase of the corona charging current exceeded 10, a half tone density rapidly changed to a solid density and images became unclear and the image quality was significantly decreased.

Japanese Patent Application No. 08-304477 filed Nov. 15, 1996, Japanese Patent Application No. 09-025347 filed Feb. 7, 1997, Japanese Patent Application No. 09-039103 filed Feb. 24, 1997, Japanese Patent Application No. 09-043158 filed Feb. 27, 1997, Japanese Patent Application No. 09-043159 filed Feb. 27, 1997, and Japanese Patent Application No. 09-304552 filed Nov. 6, 1997 are hereby incorporated by reference.

What is claimed is:

1. A corona charging method of charging a chargeable material by corona charging at least in one of a charging process, an image transfer process, or a charge quenching process for use in an image formation apparatus, in an ozone-generating hindering atmosphere consisting essentially of a non-ozone-generating gas, wherein said non-ozone-generating gas is carbon dioxide.

2. The corona charging method as claimed in claim 1, wherein said non-ozone-generating gas has a specific gravity larger than a specific gravity of air.

3. A corona charging method of charging a chargeable material by corona charging in an ozone-generation hindering atmosphere consisting essentially of a non-ozone-generating gas, comprising the steps of:

detecting whether or not a concentration of said non-ozone-generating gas in said ozone-generation hindering atmosphere is in a predetermined range in which the generation of ozone can be hindered, and when the concentration of said non-ozone-generating gas is not in said predetermined range, supplying said non-ozone-generating gas to said ozone-generation hindering atmosphere until the concentration of said non-ozone-generating gas reaches said predetermined range.

4. A corona charging method of charging a chargeable material by corona charging at a predetermined corona charging current in an ozone-generation hindering atmosphere consisting essentially of a non-ozone-generating gas, comprising the steps of:

detecting a deviation of the corona charging current from said predetermined corona charging current, and when the corona charging current is detected to be deviating from said predetermined corona charging current, supplying said non-ozone-generating gas to said atmosphere until the corona charging current reaches said predetermined corona charging current.

5. A corona charger for corona charging a chargeable member in an ozone-generation hindering atmosphere comprising a non-ozone-generating gas, comprising:

a container having an opening, for holding and maintaining said ozone-generation hindering atmosphere, a pair of electrodes disposed in said container, a high voltage power source for applying a corona charging voltage across said pair of electrodes, thereby generating corona ions in said container in order to perform corona charging said chargeable member, non-ozone-generating gas supply means for supplying said non-ozone-generating gas to said ozone-generation hindering atmosphere in said container so as to maintain said ozone-generation hindering atmosphere, non-ozone-generating gas supply adjusting means for adjusting the supply of said non-ozone-generating gas to said ozone-generation hindering atmosphere in said container so as to maintain said ozone-generation hindering atmosphere, gas detection means for detecting said non-ozone-generating gas, evaluating a concentration thereof, and outputting a signal indicating the evaluated concentration of said non-ozone-generating gas, and control means for controlling said non-ozone-generating gas supply adjusting means in response to said signal output from said gas detection means.

6. The corona charger as claimed in claim 5, wherein said non-ozone-generating gas has a specific gravity larger than a specific gravity of air, and said opening of said container is opened upward, opposite to a direction of gravity.

7. The corona charger as claimed in claim 6, wherein said non-ozone-generating gas is carbon dioxide.

8. The corona charger as claimed in claim 5, wherein said gas detection means is a gas concentration detector which watches and checks whether or not said non-ozone-generating gas supplied by said non-ozone-generating gas supply means to said ozone-generation hindering atmosphere in said container is in an appropriate range so as to maintain said ozone-generation hindering atmosphere.

9. The corona charger as claimed in claim 5, wherein said gas detection means is a generation gas concentration detector which detects a gas which is generated in the presence of air during the corona charging in said ozone-generation hindering atmosphere, and evaluates the concentration thereof.

10. The corona charger as claimed in claim 9, wherein said gas which is generated in the presence of air during the corona charging in said ozone-generation hindering atmosphere is ozone.

11. The corona charger as claimed in claim 9, wherein said gas which is generated in the presence of air during the corona charging in said ozone-generation hindering atmosphere is a NOx gas.

12. The corona charger as claimed in claim 5, wherein said gas detection means is a gas concentration detector which watches and checks whether or not air enters said ozone-generation hindering atmosphere in said container and evaluates the concentration of air in said ozone-generation hindering atmosphere.

13. A corona charger for corona charging a chargeable member at a predetermined corona charging current in an ozone-generation hindering atmosphere comprising a non-ozone-generating gas, comprising:

a container having an opening, for holding and maintaining said ozone-generation hindering atmosphere, a pair of electrodes disposed in said container, a high voltage power source for applying a corona charging voltage across said pair of electrodes, thereby generating corona ions in said container in order to perform corona charging said chargeable member, non-ozone-generating gas supply means for supplying said non-ozone-generating gas to said ozone-generation hindering atmosphere in said container so as to maintain said ozone-generation hindering atmosphere, non-ozone-generating gas supply adjusting means for adjusting the supply of said non-ozone-generating gas to said ozone-generation hindering atmosphere in said container so as to maintain said ozone-generation hindering atmosphere, a corona charging current detection means for detecting a deviation of the corona charging current from said predetermined corona charging current, evaluating the deviation thereof, and outputting a signal indicating the evaluated deviation of said corona charging current, and control means for controlling said non-ozone-generating gas supply adjusting means in response to said signal output from said corona charging current detection means.

14. The corona charger as claimed in claim 13, wherein said non-ozone-generating gas has a specific gravity larger than a specific gravity of air, and said opening of said container is opened upward, opposite to a direction of gravity.

15. The corona charger as claimed in claim 14, wherein said non-ozone-generating gas is carbon dioxide.

16. A corona charger for corona charging a chargeable member in an ozone-generation hindering atmosphere comprising a non-ozone-generating gas having a specific gravity larger than a specific gravity of air, wherein said non-ozone-generating gas is carbon dioxide, comprising a container having an upper opening, which holds said ozone-generation hindering atmosphere, which is disposed below said chargeable member, with said upper opening thereof being directed toward said chargeable member.

17. The corona charger as claimed in claim 16, further comprising non-ozone-generating gas supply means for supplying said non-ozone-generating gas to said ozone-generation hindering atmosphere, which is connected to said container.

18. The corona charger as claimed in claim 17, wherein said non-ozone-generating gas supply means is a gas cylinder filled with said non-ozone-generating gas with high pressure.

19. A corona discharger, for corona charging a chargeable member in an ozone-generation hindering atmosphere comprising a non-ozone-generating gas having a specific gravity larger than a specific gravity of air, comprising a container having an upper opening, which holds said ozone-generation hindering atmosphere, which is disposed below said chargeable member, with said upper opening thereof being directed toward said chargeable member, and non-ozone-generating gas supply means for supplying said non-ozone-generating gas to said ozone-generation hindering atmosphere, which is connected to said container, wherein said non-ozone-generating gas supply means is connected to said container at a bottom portion thereof.

20. The corona charger as claimed in claim 19, wherein said non-ozone-generating gas supply means is a gas cylinder filled with said non-ozone-generating gas with high pressure.

21. An image formation apparatus which comprises a charging unit, an image transfer unit and a charge quenching unit for charging a photoconductor comprising an amorphous silicon serving as a chargeable material, wherein in at least one of said charging unit, said image transfer unit and said charge quenching unit, corona charging is carried in an ozone-generation hindering atmosphere comprising a non-ozone-generating gas having a specific gravity larger than a specific gravity of air, wherein said non-ozone-generating gas is carbon dioxide.

22. An image formation apparatus comprising a charger for corona charging a latent electrostatic image bearing member in an ozone-generation hindering atmosphere comprising a non-ozone-generating gas which has a specific gravity larger than a specific gravity of air, wherein said non-ozone-generating gas is carbon dioxide.

23. An image formation apparatus comprising a charger for corona charging a latent electrostatic image bearing member in an ozone-generation hindering atmosphere comprising a non-ozone-generating gas which has a specific gravity larger than a specific gravity of air, said latent electrostatic image bearing member bearing a latent electrostatic image formed by being exposed to a white light emitted from a white light exposure light source, wherein said non-ozone-generating gas is carbon dioxide.

24. The image formation apparatus as claimed in claim 23, wherein said latent electrostatic image bearing member is a photoconductor having a photosensitivity of 0.1 $mJ/m^2$ or more.

25. An image formation apparatus comprising a charger for corona charging a latent electrostatic image bearing member in an ozone-generating hindering atmosphere comprising a non-ozone-generating gas which has a specific gravity larger than a specific gravity of air, said latent electrostatic image bearing member bearing a latent electrostatic image formed by being exposed to a green to blue light emitted from a single color exposure light source, wherein said non-ozone-generating gas is carbon dioxide.

26. An image formation apparatus which comprises:

a charging unit, an image transfer unit, a charge quenching unit, wherein at least one of said charging unit, said image transfer unit or said charge quenching unit comprises a corona charger for corona charging a chargeable material, in which corona charging is carried out in an ozone-generation hindering atmosphere comprising a non-ozone-generating gas having a specific gravity larger than a specific gravity of air, said corona charger comprising a container having an upper opening, which holds said ozone-generation hindering atmosphere, which is disposed below said chargeable material, with said upper opening thereof being directed toward said chargeable material, and non-ozone-generating gas supply means for supplying said non-ozone-generating gas to said ozone-generation hindering atmosphere in said container so as to maintain said ozone-generation hindering atmosphere, gas detection means for detecting said non-ozone-generating gas, measuring and evaluating a residual amount of said non-ozone-generating gas in said non-ozone-generating gas supply means, and outputting a signal indicating the evaluated residual amount of said non-ozone-generating gas, and warning display means for providing a warning display signal when the residual amount of said non-ozone-generating gas in said non-ozone-generating gas supply means decreased below a predetermined amount in response to said signal indicating the evaluated residual amount of said non-ozone-generating gas.

27. The image formation apparatus as claimed in claim 26, wherein said gas detection means is a pressure meter for evaluating the pressure of said non-ozone-generating gas supplied from said non-ozone-generating gas supply means.

28. The image formation apparatus as claimed in claim 26, wherein said gas detection means is a flow rate meter for evaluating the flow rate of said non-ozone-generating gas supplied from said non-ozone-generating gas supply means.

29. The image formation apparatus as claimed in claim 26, wherein said non-ozone-generating gas supply means comprises a gas cylinder for holding said non-ozone-generating gas therein.

* * * * *